US006007227A

United States Patent [19]

Carlson

[11] Patent Number: 6,007,227

[45] **Date of Patent: *Dec. 28, 1999**

[54] BLENDER CONTROL SYSTEM

[75] Inventor: Bradley T. Carlson, Cypress, Tex.

[73] Assignee: BJ Services Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,808

[22] Filed: Mar. 12, 1997

[51] Int. Cl.[6] ..... G05B 11/32; G05B 15/02; G06F 17/00

[52] U.S. Cl. ..... 364/172; 364/138; 364/479.09; 364/528

[58] Field of Search ..... 364/502, 172, 364/528, 188, 138, 528.2, 479.09

[56] References Cited

U.S. PATENT DOCUMENTS

| | | | |
|---|---|---|---|
| Re. 30,019 | 6/1979 | Lindquist | 166/250 |
| 4,192,551 | 3/1980 | Weimer et al. | 299/1.4 |
| 4,239,396 | 12/1980 | Arribau et al. | 366/2 |
| 4,538,221 | 8/1985 | Crain et al. | 364/172 |
| 4,538,222 | 8/1985 | Crain et al. | 364/172 |
| 4,751,648 | 6/1988 | Sears, III et al. | 702/6 |
| 4,779,186 | 10/1988 | Handke et al. | 364/172 |
| 4,916,631 | 4/1990 | Crain et al. | 364/502 |
| 4,953,097 | 8/1990 | Crain et al. | 364/502 |
| 5,014,218 | 5/1991 | Crain et al. | 364/502 |
| 5,027,267 | 6/1991 | Pitts et al. | 364/172 |
| 5,289,877 | 3/1994 | Naegele et al. | 166/285 |
| 5,320,425 | 6/1994 | Stephenson et al. | 366/1 |
| 5,365,435 | 11/1994 | Stephenson | 364/420 |
| 5,570,743 | 11/1996 | Padgett et al. | 166/285 |

OTHER PUBLICATIONS

SPE 17315 "Fracturing Process Control and Automation", pp. 371–377, 1988, Tomllnson, et al.

SPE 26220, "Fracturing Process Control and Automation: Phase 2", pp. 43–49, 1993, Stephenson, et al.

*Primary Examiner*—Albert De Cady
*Assistant Examiner*—Shelly A Chase
*Attorney, Agent, or Firm*—Arnold White & Durkee; Mark L. Gleason

[57] ABSTRACT

A general purpose control system for use in the oilfield pressure pumping service industry. The system is comprised of a dedicated control computer mounted on the apparatus to be controlled and one or more remote operator units. The dedicated control computer interfaces with all the sensors and control elements of the apparatus. The control computer performs all the calculations necessary to control the apparatus. The dedicated control computer communicates with other computerized equipment on the apparatus such as engines, pressure sensors, speed sensors and flowmeters to extract data and perform control functions. The dedicated control computer has no operator controls. The dedicated control computer communicates via a single electrical cable to the operator control pendants. The control pendant is a small portable unit that provides the complete operator interface. The control pendant is comprised of graphic/alpha-numeric liquid crystal display and light emitting diode displays which provide the operating status of the system. The control pendant also includes key switches which are used for controlling the apparatus.

24 Claims, 9 Drawing Sheets

BLENDER CONTROL SYSTEM

BACKGROUND OF THE INVENTION

1. Field of the Invention

The present invention relates generally to oilfield control systems and, more particularly, to general purpose oilfield control systems.

2. Background of the Invention

Oilfield control systems are commonly used for controlling and monitoring oilfield equipment and processes. Given their widespread and increasing use, it is important that such devices be both reliable in operation and easily operated.

SUMMARY OF THE INVENTION

In accordance with one aspect of the present invention, a blender system for preparing fluid mixtures for fracturing and propping oil bearing geological formations is provided that includes a blender apparatus adapted to prepare the fluid mixtures that includes a plurality of control devices adapted to receive a plurality of control signals and a plurality of sensing devices adapted to transmit a plurality of sensor signals, a programmable system controller operably coupled to the blender apparatus adapted to transmit the control signals and receive the sensor signals, and a plurality of control pendants operably coupled to the programmable system controller adapted to receive input commands from an operator and display status conditions of the control devices and sensing devices.

In accordance with another aspect of the present invention, a method of operating a blender system for preparing fluid mixtures for fracturing and propping oil bearing geological formations including a plurality of control devices adapted to receive a plurality of control signals and a plurality of sensing devices adapted to transmit a plurality of sensor signals is provided in which sensor signals generated by the blender system are processed to generate control signals for controlling control devices within the blender system.

BRIEF DESCRIPTION OF THE DRAWINGS

The present invention will become more fully understood from the following detailed description of the preferred embodiments, taken in conjunction with the accompanying drawings in which.

DESCRIPTION OF ILLUSTRATIVE EMBODIMENTS

Figure 1A:
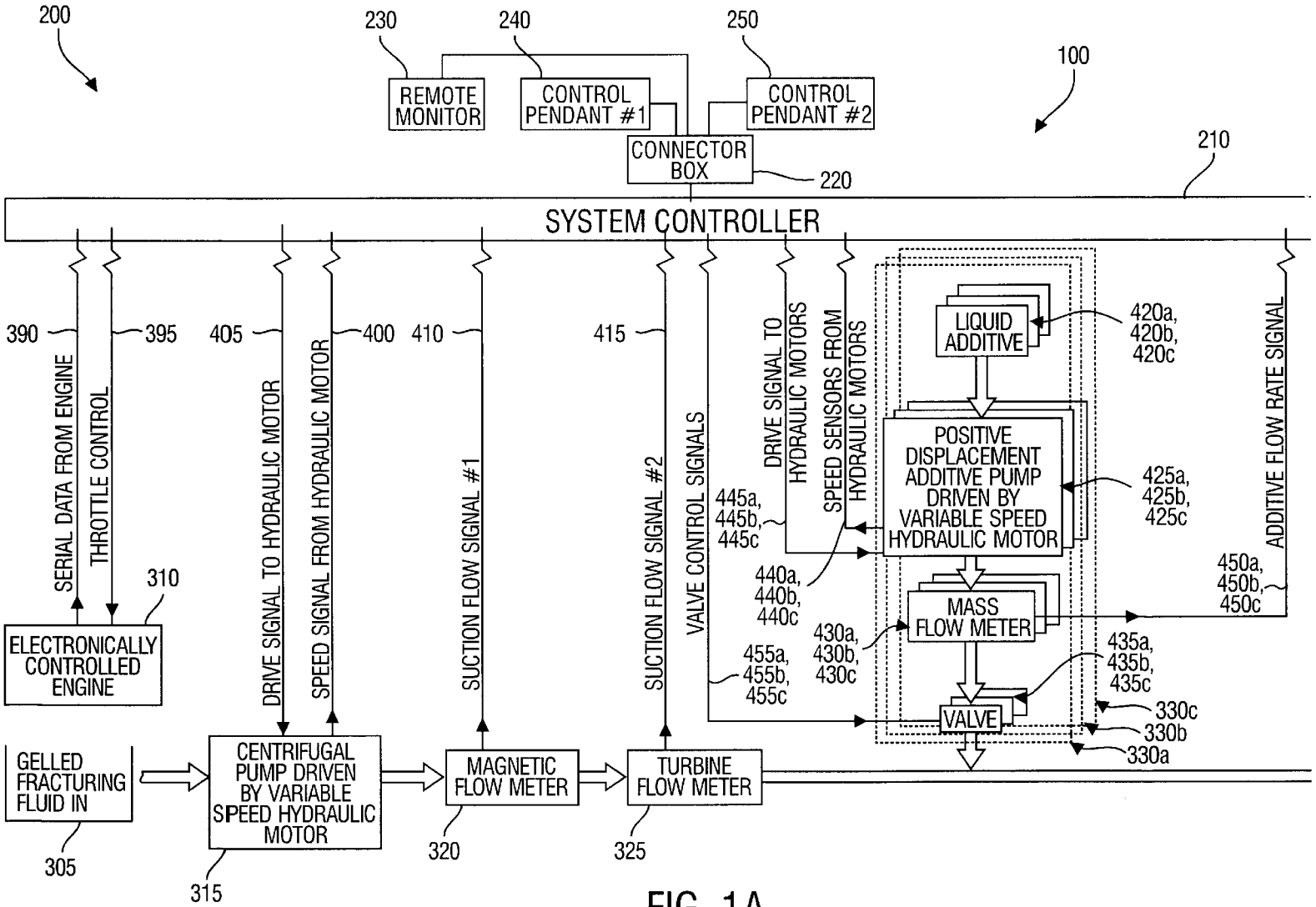
FIGS. 1*a*, 1*b* and 1*c* are an illustration of a preferred embodiment of a blender system.

The illustrative embodiments described herein provide a blender system for preparing fluid mixtures for fracturing and propping oil bearing geological formations. The blender system includes a general purpose oilfield control system for control and monitoring of the blender system. While illustrated by means of specific illustrative embodiments providing a blender system including a general purpose oilfield control system, the present invention will also find broad application to a wide-range of applications calling for general purpose control of equipment and/or processes. Therefore, the illustration by means of a blender system having a general purpose oilfield control system is meant to be illustrative and not limiting.

The blender system generally provides a method and apparatus for controlling and monitoring several types of equipment used in the oilfield pressure pumping service industry in order to prepare fluid mixtures for fracturing and propping oil bearing geological formations. The blender system is designed to mix various chemicals and proppants in a well known manner prior to being pumped into an oil well for the purpose of fracturing and propping the oil bearing geological formation.

Fracturing and propping an oil well is a well known process in which fluid, generally water or oil, is pumped into an oil well at high flow rates (typically 200 to 5000 gallons per minute) and high pressures to hydraulically fracture the underlying oil bearing formation. The fluid is combined with any number of chemicals to produce certain fluid properties. Generally the fluid is mixed with certain polymers to increase its viscosity and allow it to transport a proppant into the fracture created. The fluid is further designed to lose viscosity once it is in the fracture allowing it to leave the porous proppant in the fracture to provide a path for the oil to flow back to the well bore.

Referring to FIGS. 1*a*, 1*b*, 1*c*, 2, 3, 4, 5, 6 and 7, a preferred embodiment of a blender system 100 will now be described. The blender system includes a general purpose oilfield control system 200 and a blending assembly 300. The control system 200 controls and monitors the operation of the blending assembly 300 by transmitting a plurality of control signals and receiving and processing a plurality of operational status signals to and from the blending assembly 300. The blending assembly 300 prepares fluid mixtures for fracturing and propping oil bearing geological formations. In a preferred embodiment, the blender system 100 is mounted upon a motorized vehicle such as a heavy duty truck or other similar vehicle to permit the blender system 100 to be transported to any number of oil bearing geological formations.

The control system 200 includes a system controller 210, a connection box 220, a remote monitor 230, a first control pendant 240, and a second control pendant 250. The system controller 210 provides the control and monitoring function of the control system 200 and communicates with all of the components of the blender assembly 300, the remote monitor 230, and the control pendants 240 and 250 either directly or through the connection box 220. The connection box 220 permits all of the components of the blender system 100 to be easily connected or disconnected using standard connector hardware. The remote monitor 230 provides remote monitoring of the operational status of the blender system 100. The control pendants 240 and 250 permit an operator to input commands to the system controller 210 as well as display the operational status of the blender system 100. Although a single control pendant 240 may be utilized in the control system 200, in a preferred embodiment a plurality of such control pendants 240 and 250 are used in order to provide redundancy in the control system 200.

The architecture of the present preferred embodiment of the blender system 100 places all of the control functions in the system controller 210. All of the operator interface with the blender system 100 is then performed via the control pendants 240 and 250. This modular design has many advantages during operation of the blender system.

For example, the use of control pendants 240 and 250 allows operation from virtually anywhere (e.g.,. on top the blender assembly 300, beside the blender assembly 300, in any remote control location, or from two sites simultaneously). This increased mobility enhances the safety of the operator.

The use of two control pendants 240 and 250 also provides redundancy for reliability. The blender system 100 may therefore be operated from a remote monitoring van. This allows the blender operator to be adjacent to the job supervisor, providing better communications between them, an important factor on stimulation jobs.

Furthermore, automation based upon a single control computer, as opposed to multiple individual controllers, allows for easier synchronization of the multiple additives required in stimulation treatments. Thus, the present preferred embodiment will permit complicated stimulation jobs to be performed that in the past were simply impractical or even impossible to perform.

For example, using prior designs, the introduction of each additive was controlled by a discrete automated controller. While the prior controllers could track a common base rate, it was necessary to start and stop them individually. This staging can now be accomplished utilizing the teachings of the present illustrative embodiments according to a preprogrammed schedule. In this manner, the introduction of additives and proppants are all under the control of a common computer and may therefore be synchronized. And since the staging can be preprogrammed before initiating the process, the operator does not have to manually flip switches and control buttons off and on under conditions that place great stress upon the operator.

The dual remote/single cable configuration will also prove useful in many instances such as marine applications where it is desirable to control a unit both locally and remotely with only a single small cable (five conductors) connecting the remote pendant to the unit. This will also significantly reduce the cost of wiring and installation in remote marine applications.

The architecture of the blender system 100 is also very cost effective and easy to service. The use of two identical pendants 240 and 250 allow any problem with a control pendant to be isolated merely by exchanging pendants. The control pendant may also be changed during a job by simply unplugging one and plugging in a new one, this can be done while the equipment is running without affecting the job. The system controller 210 which contains all of the electronic control components for the blender system 100 may be exchanged by unplugging a few connectors and installing a new one. The size and weight of the control pendants 240 and 250 allow a person servicing a mechanical portion of the system to move a control pendant to the location being serviced, i.e. in front of a liquid additive pump. This eliminates the need for a second person to operate the blender system 100 while the technician performs service.

The control system will also preferably include a diagnostic computer (not illustrated) to permit testing of the blender system 100 as well as the capability to modify the operating software of the components of the control system 200. The diagnostic computer may comprise any number of programmable general-purpose computers, modified in accordance with the teachings of the illustrative embodiments. In a preferred embodiment, the diagnostic computer is a portable laptop computer available from Compaq or NEC. In an alternative embodiment, any commercially available personal computer with appropriate software may substituted for the diagnostic computer.

The system controller 210 may comprise any number of conventional programmable microcontrollers modified for operation in accordance with the teachings of the illustrative embodiments such as, for example, a model 7108 system available from Texas Microsystems or a model 7872 available from Prolog. In a preferred embodiment, the system controller 210 is a unit available from BJ Services of Houston, Tex. modified in accordance with the teachings of the illustrative embodiments. The system controller 210 may be programmed using any number of conventional programming languages such as, for example, Pascal, Basic or Fortran. In a preferred embodiment, the system controller 210 is programmed using a combination of Assembly language and C programming languages.

Figure 2:
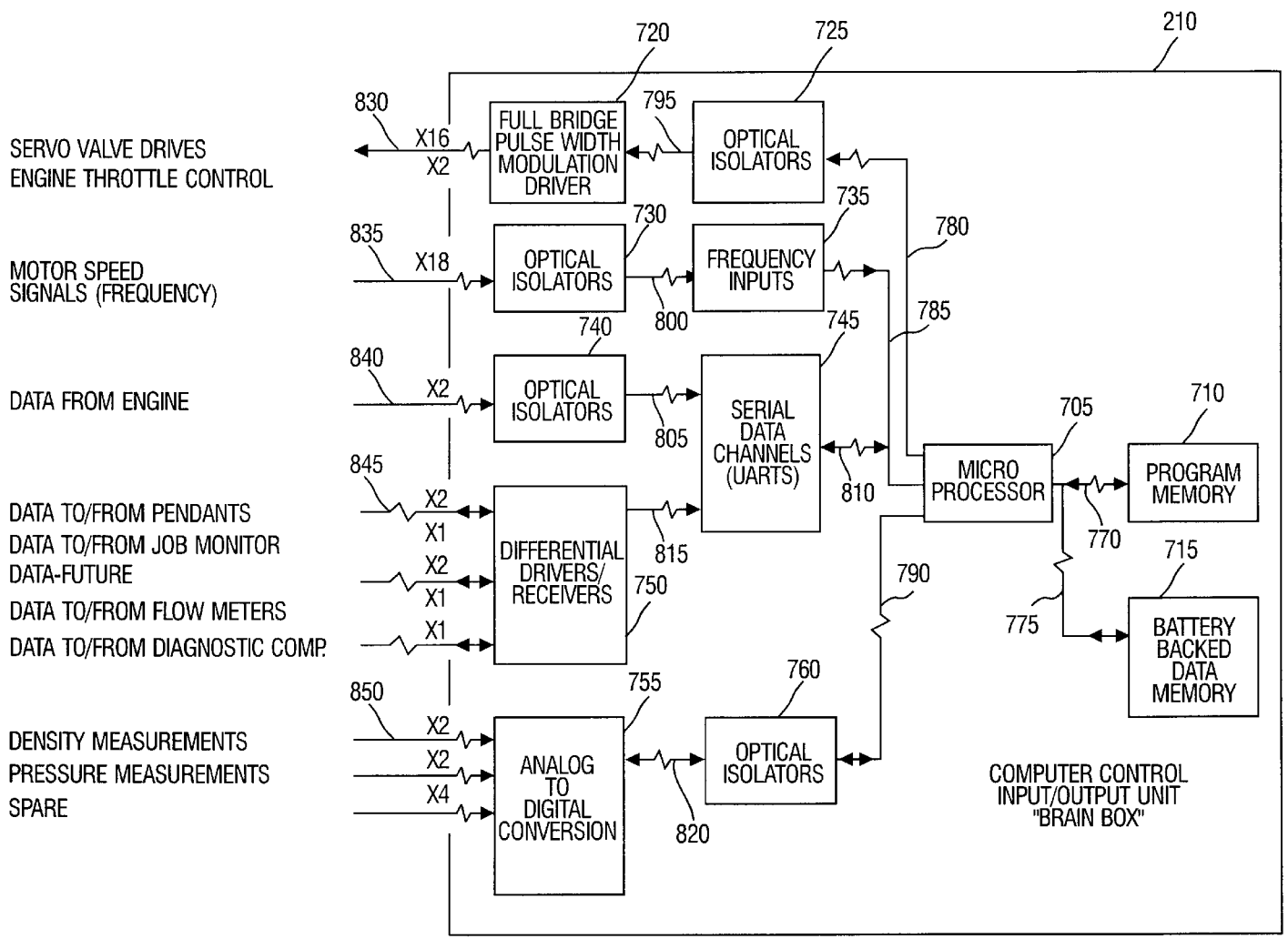
FIG. 2 is a schematic block diagram of the system controller used in the blender system of FIGS. 1*a*, 1*b* and 1*c;*

As illustrated in FIG. 2, the system controller 210 preferably includes a microprocessor 705, a program memory 710, a battery-backed-up data memory 715, a full bridge pulse-width-modulation (PWM) driver 720, a first set of optical isolators 725, a second set of optical isolators 730, frequency inputs 735, a third set of optical isolators 740, serial data transceivers 745, differential drivers/receivers 750, analog-to-digital conversion 755, fourth set of optical isolators 760, communication busses 770, 775, 780, 785, 790, 795, 800, 805, 810, 815 and 820, and input-output connections 830, 835, 840, 845 and 850.

The microprocessor 705 may comprise any number of conventional commercially available microprocessors, modified in accordance with the teachings of the illustrative embodiments, such as, for example, an Intel Pentium™ or a Motorola Power PC™. In a preferred embodiment, the microprocessor 705 is a 68332 microcontroller available from Motorola that provides sixteen integral counter timers. These sixteen integral counter timers are used to generate variable duty cycle pulse width modulation (PWM) control signals for use in controlling the servo valves in the blender assembly 300.

The microprocessor 705 may be programmed using any number of conventional programming languages and compilers such as, for example, Pascal, Basic or Forth. In a preferred embodiment, the microprocessor is programmed using a combination of Motorola 68000 assembly language and C computer language.

The microprocessor 705 communicates in a conventional manner with the program memory 710 via the communication bus 770. In this manner, the operating software for the system controller resident in the program memory 710 may be accessed and processed by the microprocessor 705. The contents of the program memory 710 may be modified by either physically replacing the program memory 710 or by remotely accessing the program memory 710 in a well known manner.

The microprocessor 705 communicates with the battery-backed data memory 715 in a conventional manner via the communication busses 770 and 775. In this manner, the microprocessor modifies, stores and retrieves the contents of the battery-backed data memory 715.

The program memory 710 may comprise any number of conventional commercially available volatile or non-volatile memory devices, modified in accordance with the teachings of the illustrative embodiments, such as, for example, battery-powered DRAMS, SRAMS, FLASH EPROMS, EPROMS or EEPROMS. In a preferred embodiment, the program memory 710 is an EPROM available from SGS Thompson. The program memory 710 will preferably include at least 256 K×16 of memory capacity. In an alternative embodiment, a disk drive and DRAM combination such as, for example, that typically used in industrial computers may be substituted for the program memory 710.

The battery-backed data memory 715 may comprise any number of conventional commercially available battery-backed non-volatile memory devices, modified in accordance with the teachings of the illustrative embodiments, such as, for example, DRAMS or SRAMS. In a preferred embodiment, the data memory 715 is an SRAM available from Hitachi powered by a lithium battery. In an alternative preferred embodiment, a non-volatile memory device such as, for example, a FLASH EPROM may be substituted for the battery-backed data memory 715. The battery-backed data memory will preferably include at least about 128 K×16 of memory capacity.

The full bridge pulse-width-modulation (PWM) driver 720 may comprise any number of conventional commercially available full bridge pulse-width-modulation (PWM) drivers, modified in accordance with the teachings of the illustrative embodiments. In a preferred embodiment, the full-bridge pulse-width-modulation (PWM) driver 720 is a UDN 2998 available from Sprague that is capable of delivering ±1 amp to the servo valves within the blender assembly 300. In an alternative preferred embodiment, a linear device such as, for example, a high-power operational amplifier may be substituted for the full-bridge pulse-width-modulation (PWM) driver 720. The full-bridge pulse-width-modulation (PWM) driver 720 generates one or more PWM control signals in a conventional manner under the control of the microprocessor 705. As is well known in the art, PWM signals are signals in which the width of a square wave pulse is controllably varied in order to control the operation of a device.

The first set of optical isolators 725 may comprise any number of conventional commercially available optical isolators, modified in accordance with the teachings of the illustrative embodiments. In a preferred embodiment, the first set of optical isolators 725 is a HPCL-2231 available from Hewlet-Packard. In an alternative preferred embodiment, an inductive isolation device such as, for example, a transformer with appropriate signal conditioning may be substituted for the first set of optical isolators 725. The first set of optical isolators 725 optically isolate the microprocessor 705 from the full-bridge pulse-width-modulation (PWM) driver 720 in a well known manner in order to protect the microprocessor 705.

In a preferred embodiment, the first set of optical isolators 725 transmit the variable duty cycle pulse width modulation signals generated by the microprocessor 705 to the full bridge pulse width modulation driver 720.

The second set of optical isolators 730 may comprise any number of conventional commercially available optical isolators, modified in accordance with the teachings of the illustrative embodiments. In a preferred embodiment, the second set of optical isolators 730 are HPCL2231 available Hewlett-Packard that provides eighteen channels of optical isolation. In an alternative preferred embodiment, an inductive isolation device such as, for example, a transformer with appropriate signal conditioning may be substituted for the second set of optical isolators 730. The second set of optical isolators 730 optically isolate the microprocessor 705 and frequency inputs 735 from incoming signals in a well known manner in order to protect the microprocessor 705 and frequency inputs 735.

In a preferred embodiment, the second set of optical isolators 730 receive frequency information from conventional magnetic speed sensors positioned on the hydraulic motors and optical encoders positioned within the blender assembly 300 and transmit these signals to the frequency inputs 735.

The frequency inputs 735 may comprise any number of conventional counters/timers configured in an array, modified in accordance with the teachings of the illustrative embodiments, such as, for example, a Motorola 6840. In a preferred embodiment, the frequency inputs 735 are an array of counters/timers having part numbers 82C54 available from Intel. In an alternative preferred embodiment, embedded counters such as, for example, those commonly internal to the Motorola 68332 microcontroller may be substituted for the frequency inputs 735. The frequency inputs 735 receive incoming signals via the input-output connection 835, optical isolators 730, and communication bus 800 and generate 5 volt logic level signals in a well known manner. The logic level signals are then transmitted to the microprocessor 705 via the communication bus 785.

The third set of optical isolators 740 may comprise any number of conventional commercially available optical isolators, modified in accordance with the teachings of the illustrative embodiments. In a preferred embodiment, the third set of optical isolators 740 are HPCL 2231 available from Hewlet-Packard. In an alternative preferred embodiment, an inductive isolation device such as, for example, a transformer with appropriate signal conditioning may be substituted for the third set of optical isolators 740. The third set of optical isolators 740 optically isolate the microprocessor 705 and serial data transceivers 745 from incoming signals in a well known manner in order to protect the microprocessor 705 and serial data transceivers 745.

In a preferred embodiment, the third set of optical isolators 740 receive serial engine data signals from the blender assembly 300 and transmit these to the serial data converter 745.

The serial data converter 745 may comprise any number of conventional commercially serial data channels, modified in accordance with the teachings of the illustrative embodiments. In a preferred embodiment, the serial data converter 745 is a Universal Asynchronous Receiver and Transmitters (UART) model no. 68C198 available from Phillips. In an alternative preferred embodiment, another commercially available converter device such as, for example, a Motorola 68681 may be substituted for the serial data converter 745. The serial data converter 745 receives incoming signals via the input-output connection 840, optical isolators 740, and communication bus 805 and generates parallel digital logic level signals in a well known manner. The logic level signals are then transmitted to the microprocessor 705 via the communication busses 785 and 810.

The differential drivers/receivers 750 may comprise any number of conventional commercially available differential drivers/receivers, modified in accordance with the teachings of the illustrative embodiments. In a preferred embodiment, the differential drivers/receivers 750 are 96176 available from Texas Instruments. In an alternative preferred embodiment, a similar device such as, for example, a Texas Instruments 75176 may be substituted for the differential drivers/receivers 750. The differential drivers/receivers 750 transmit, receive and buffer signals via the input-output connection 845 and transmit, receive and buffer RS-485/422 signals in a well known manner. The RS-485/422 signals are then transmitted, buffered and received by the serial data converter 745 via the communication bus 815. The serial data transceivers 745 in turn transmit, receive and buffer signals as parallel data to and from the microprocessor 705 via the communication busses 785 and 810.

The analog-to-digital converters 755 may comprise any number of conventional commercially available analog-to-digital converters, modified in accordance with the teachings of the illustrative embodiments. In a preferred embodiment, the analog-to-digital converters 755 is an eight-channel/twelve-bit digital-to-analog converter part no. LT 1294 available from Linear Technologies. In an alternative preferred embodiment, another commercially available device such as, for example, an Analog Devices 7582 may be substituted for the analog-to-digital converters 755. The analog-to-digital converters 755 receive and process incoming analog signals via the input-output connection 850 in a well known manner to generate digital signals. The digital signals are transmitted from the analog-to-digital converters to the microprocessor 705 via the serial communication bus 820, optical isolators 760, and serial communication bus 790.

In a preferred embodiment, the analog-to-digital converters 755 receive analog signals from the densimeter 385 and pressure sensors 335 and 370, digitize these signals, and transmit them to the microprocessor 705 via the fourth set of optical isolators 760.

The fourth set of optical isolators 760 may comprise any number of conventional commercially available optical isolators, modified in accordance with the teachings of the illustrative embodiments. In a preferred embodiment, the fourth set of optical isolators 760 are a HPCL 2231 available from Hewlett Packard. In an alternative preferred embodiment, an inductive isolation device such as, for example, a transformer with appropriate signal conditioning may be substituted for the fourth set of optical isolators 760. The fourth set of optical isolators 760 optically isolate the microprocessor 705 from the analog-to-digital converters 755 in a well known manner in order to protect the microprocessor 705.

The sets of optical isolators 725, 730, 740 and 760 further serve to minimize interference caused by ground loops and stray radio interference.

The communications busses 770, 775, 780, 785, 790, 795, 800, 805, 810, 815 and 820 may comprise any number of conventional serial and/or parallel communication busses with conventional supporting circuitry and software for facilitate their operation. In a preferred embodiment, the busses 780, 790, 800, 805 and 815 are serial communication busses and the busses 770, 775, 785 and 810 are parallel communication busses.

The input-output connections 830, 835, 840, 845 and 850 may comprise any number of conventional electrical connectors such as, for example, standard military standard connectors. In a preferred embodiment, the input-output connections 830 is an AMP P/N 770669 header mated with an AMP P/N 770680-1 plug, the input-output connection 835 is an AMP P/N 770669 header mated with an AMP P/N 770680-1 plug, the input-output connection 840 is an AMP P/N 770669 header mated with an AMP P/N 770680-1 plug, the input-output connection 845 is an AMP P/N 770669 header mated with an AMP P/N 770680-1 plug, and the input-output connection 850 is an AMP P/N 770669 header mated with an AMP P/N 770680-1 plug. In a particularly preferred embodiment, the input-output connections 830, 835, 840, 845 and 850 are provided with excess capacity in order to permit additional input-output signals to be used in the blender system 100.

The system controller 210 is preferably programmed to operate the blender assembly 300 to prepare the desired fluid mixture for fracturing and propping the producing subterranean formation according to predetermined empirical algorithms to arrive at the desired properties for the fluid mixture. These predetermined empirical algorithms are considered well-known and thus are not considered further.

Figure 3:
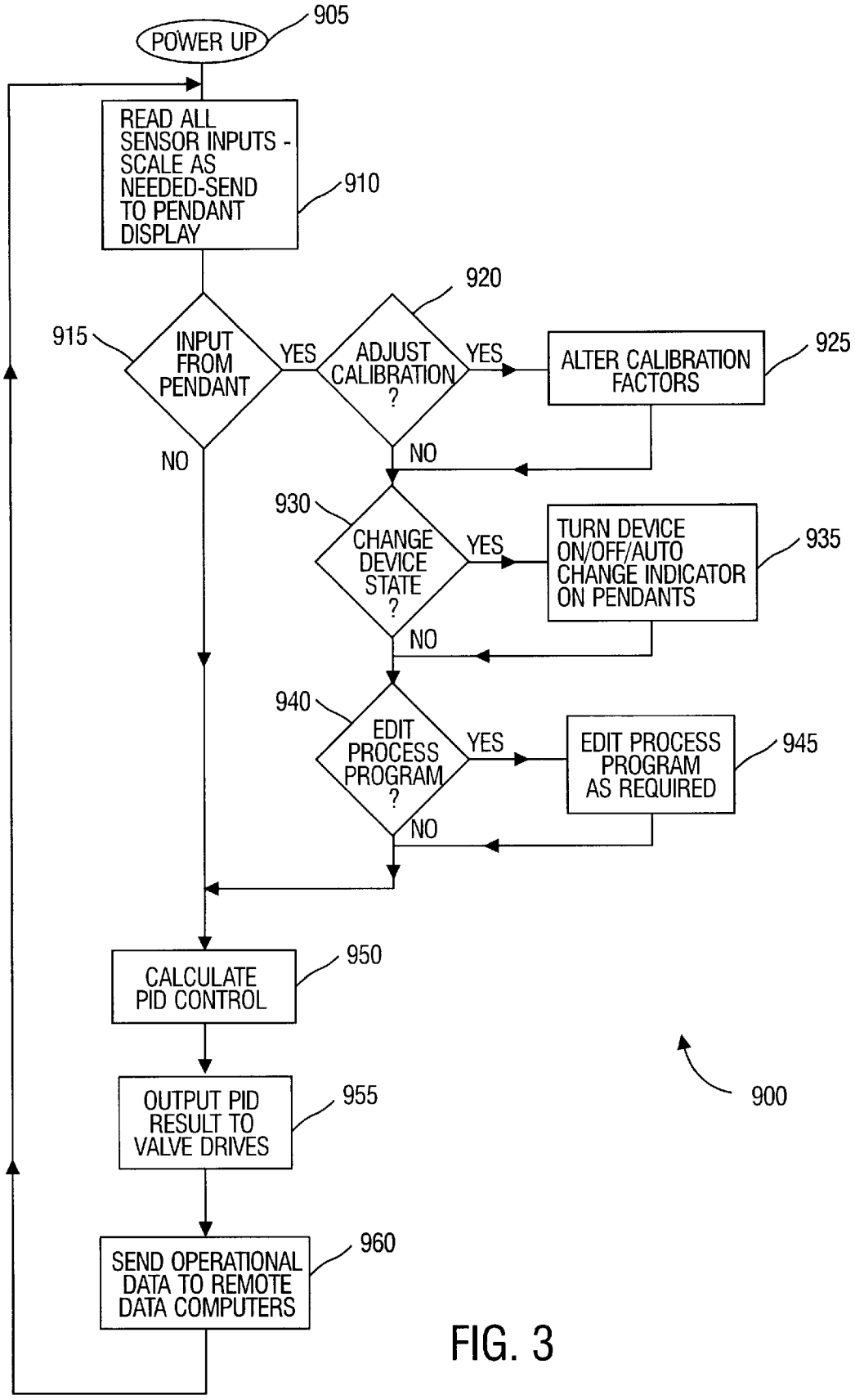
FIG. 3 is a flow chart illustrating the operation of the system controller used in the blender system of FIGS. 1*a*, 1*b* and 1*c;*

As illustrated in FIG. 3, the system controller 210 is further preferably programmed to provide control and monitoring of the blender assembly 300 in accordance with a system controller operating program 900. Using this operating program 900, the system controller constantly monitors and controls the operation of the blender assembly 300 as well as permits operator control via the control pendants 240 and 250 in a controlled and systematic fashion.

After powering up the system controller 210 in step 905, the operating program 900 directs the system controller 210 to read all sensor input signals from the blender assembly 300, scale the sensor input signals as necessary, and transmit this data to the control pendants 240 and 250, the remote monitor 230, and store it in data memory 715 in program step 910. Scaling of a sensor input signal will generally be required to convert a raw analog or digital signal to standard engineering units (e.g., PSI, RPM, GPM, etc . . . ).

In program step 915, the system controller 210 checks to see if an input signal has been received from any of the control pendants 240 or 250. If an input signal has been received from any of the control pendants 240 or 250, then the system controller 210 checks to see if the input signal from the control pendants 240 or 250 is requesting a change in calibration of one or more blender assembly devices 300 in program step 920. A calibration adjustment will generally be required on an initial configuration or when changes that affect a sensor calibration are made (e.g., switching fluid types being measured by a turbine flowmeter). If a calibration adjustment has been requested in program step 920, then the system controller 210 will adjust the calibration in program step 925 and store the result in the battery-backed data memory 715.

If an input signal from the control pendants 240 or 250 does not request the adjustment of a calibration value in program step 920 or upon the completion of program step 925, the system controller 210 will proceed to execute program step 930. In program step 930, the system controller 210 checks to see if an input signal from the control pendants 240 or 250 is requesting a change in the operational state of one or more devices in the blender assembly 300. Examples of a change in the operational state of a device within the blender assembly include turning a device on, turning a device off, and initiating automatic control of a device.

If an input signal from control pendants 240 or 250 requests a change in the operational status of one or more devices within the blender assembly 300 in program step 930, then the system controller 210 proceeds to execute program step 935. In executing program step 935, the system controller 210 generates the required control signal for transmission to the blender assembly 300 to turn the selected devices on, off, and/or automatically control the selected devices.

If an input signal from the control pendants 240 or 250 does not request a change in the operational state of one or more devices within the blender assembly in program step 930 or upon the completion of program step 935, the system controller 210 will proceed to execute program step 940. In program step 940, the system controller 210 checks to see if an input signal from one of the control pendants 240 or 250 requested a change in the blending process program.

The blending process program controls the preparation of the fluid mixtures to be used in fracturing and propping the producing geological formation. Changes in the blending process program would typically change the type and quantity of liquid additives, dry additives, and/or proppants introduced into the gelled fracturing fluid.

If an input signal from one of the control pendants 240 or 250 requests a change in II the blending process program in program step 940, then the system controller proceeds to execute program step 945. In program step 945, the system controller 210 edits the blending process program as requested and stores the result in the program memory 710.

If an input signal from the control pendants 240 or 250 does not request a change in the blending process program in program step 940 or upon the completion of program step 945, the system controller 210 will proceed to execute program step 950. In program step 950, the system controller 210 calculates feedback control signals for the devices within the blender assembly 300. These feedback control signals may be calculated according to any number of conventional feedback control system algorithms such as, for example, proportional-integral (P-I), proportional-differential (P-D), or proportional-integral-differential (P-I-D). In a preferred embodiment, these feedback control signals are calculated according to a P-I-D algorithm.

Upon the completion of program step 950, the system controller 210 executes program step 955 in which the calculated control signals generated in program step 950 are output to the blender assembly 300. In a preferred embodiment, the control signals are transmitted to the blender assembly 300 in the form of pulse-width-modulated (PWM) signals. As is well known in the art, a pulse width modulated signal is a square wave signal whose pulse width is controllably varied. In a preferred embodiment, the devices within the blender assembly 300 are typically controlled using servo valves whose degree of opening is controlled in relation to the pulse-width-modulated signals.

Upon the completion of program step 955, the system controller 210 executes program step 960. In program step 960, the system controller 210 transmits any and all operational data to the remote terminal 230 and the control pendants 240 and 250. After completing program step 960, the system controller loops up to program step 910.

The connection box 220 may comprise any number of conventional interconnection boxes or panels modified in accordance with the teachings of the present illustrative embodiments such as, for example, a type NEMA 4 available from Hoffman Inc. or Rose Enclosures. Preferably the connection box 220 is fabricated from lightweight materials and is also waterproof and shock proof in order to survive the rugged environment commonly found in oil producing areas. In a preferred embodiment, the connection box 220 is model RJ1210HLL available from Stahlin of the U.S.A. modified in accordance with the teachings of the present illustrative embodiments. The connection box 220 may incorporate a number of standard connectors such as, for example, standard military standard type or Brad Harris style. In a preferred embodiment, the connection box 220 utilizes standard military type connectors. In a preferred embodiment, the connection box is constructed to provide electrical shielding of the signals within using conventional methods of providing electrical shielding of electrical signals. In an alternative preferred embodiment, the connectors may be located within the system controller enclosure 210.

The remote monitor 230 may comprise and number of conventional visual display devices, modified in accordance with the teachings of the illustrative embodiments, such as, for example, any commercially available personal computer or programmable logic controller capable or receiving and displaying serial data. The remote monitor 230 preferably receives all pertinent data from the blender system 100 as well as all other equipment used on a stimulation job and presents it to the operator controlling the overall well treatment. In a preferred embodiment, the remote monitor 230 is a BJ Services Model 3600 Well Treatment Analyzer. In an alternative embodiment, any commercially available programmable computer capable or receiving and displaying serial data may be substituted for the remote monitor 230.

The control pendants 240 and 250 may comprise any number of conventional control devices that provide keyboard entry of commands and visual display modified in accordance with the teachings of the illustrative embodiment such as, for example, a commercially available laptop computer. In a preferred embodiment, the control pendants 240 and 250 are available from BJ Services of Houston, Tex.

Figure 4:
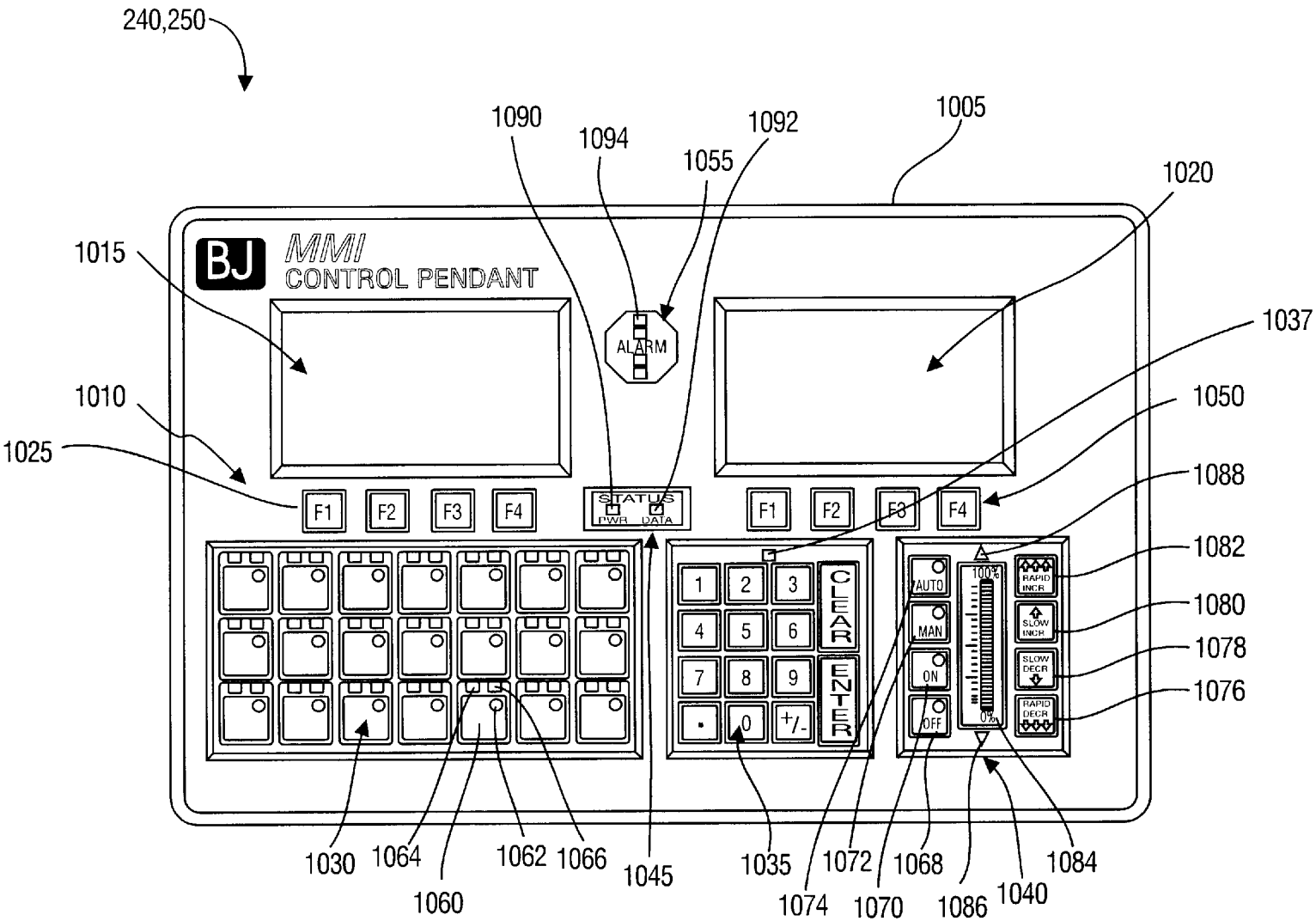
FIG. 4 is an illustration of the control pendant used in the blender system of FIGS. 1*a*, 1*b* and 1*c;*
Figure 5:
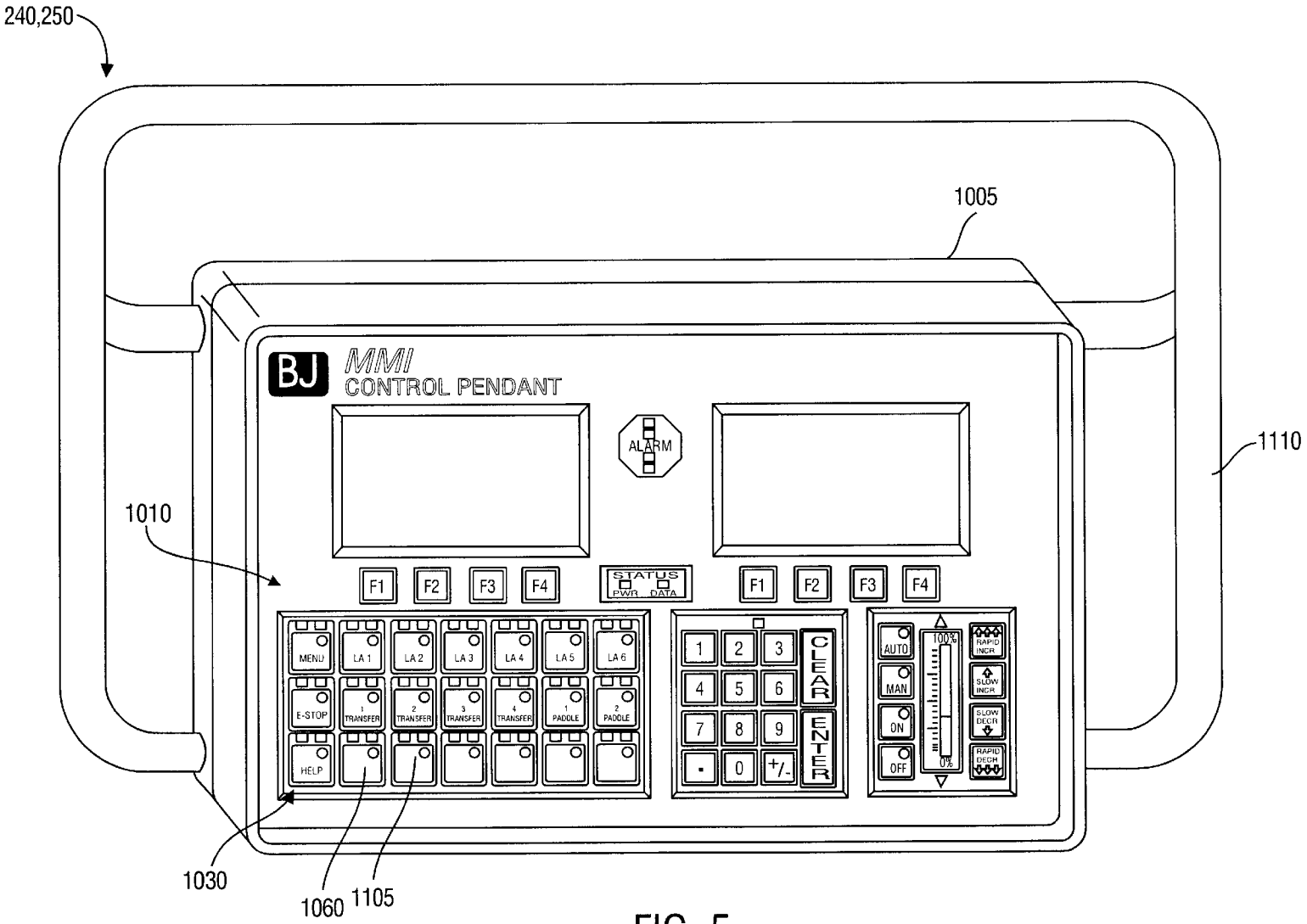
FIG. 5 is another illustration of the control pendant used in the blender system of FIGS. 1*a*, 1*b* and 1*c;*
Figure 6:
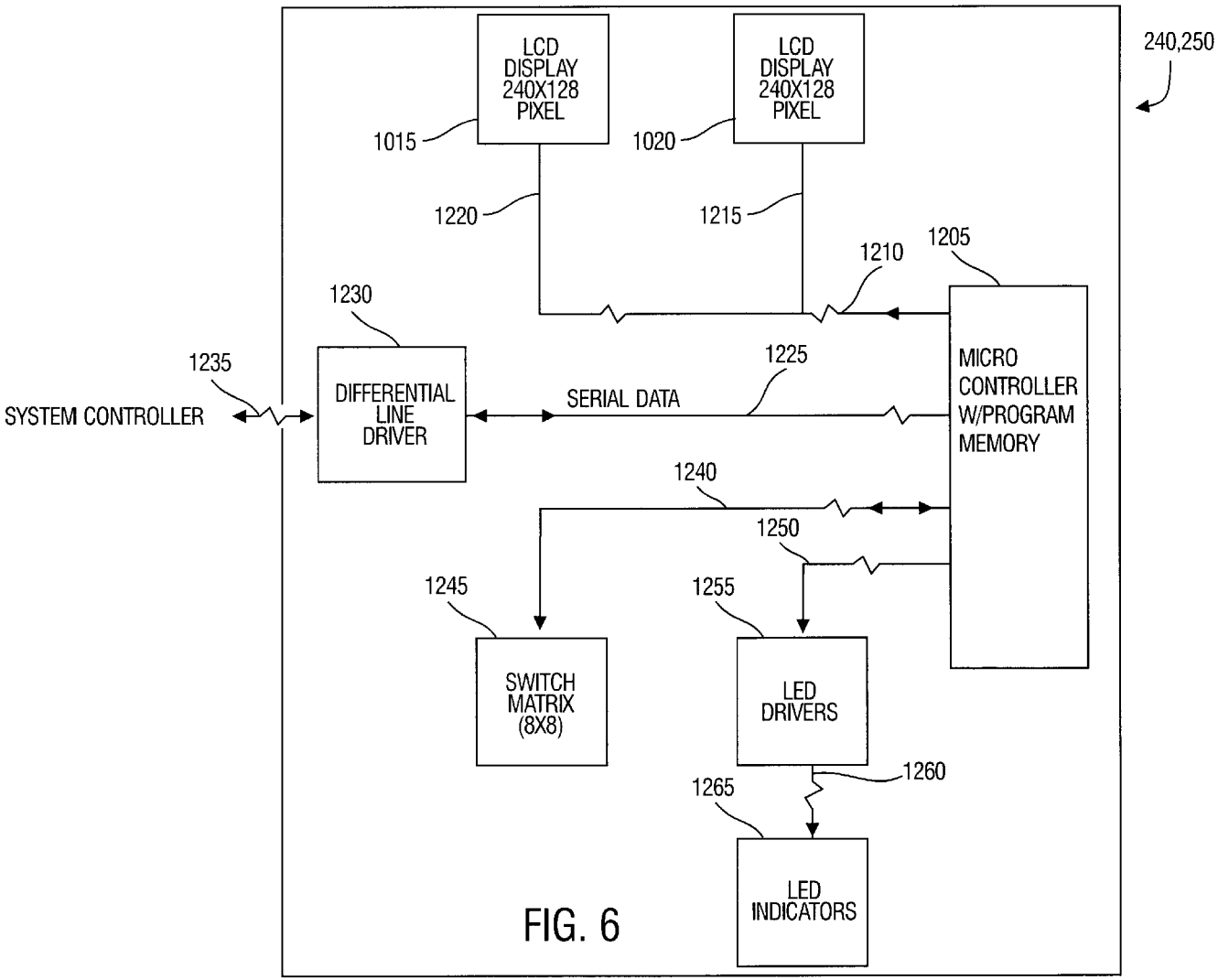
FIG. 6 is a schematic block diagram of the control pendant used in the blender system of FIGS. 1*a*, 1*b* and 1*c*.

As illustrated in FIGS. 4, 5 and 6, in a particularly preferred embodiment the control pendants 240 and 250 include a housing 1005, a face plate 1010 to permit the placement of a plurality of displays and keyboards, a first display 1015, a second display 1020, a first group of function keys 1025, a general purpose keyboard 1030, a data entry keyboard 1035, a special-purpose keyboard and display 1040, a status display 1045, a second group of function keys 1050, and an alarm display 1055.

The housing 1005 may comprise any number of conventional commercially available lightweight housings, modified in accordance with the teachings of the illustrative embodiments, such as, for example, cast aluminum or molded plastic housings. In a preferred embodiment, the housing 1005 is lightweight, waterproof, and shock resistant in order to survive in the rugged environment typically found in areas adjacent to an oil producing locations. In a particularly preferred embodiment, the housing 1005 is a 02 style housing available from Rose Enclosures. In an alternative embodiment, a similar enclosure such as, for example, those manufactured by Bud enclosures or Hoffman Inc. may be substituted for the housing 1005.

The face plate 1010 may comprise any number of conventional commercially available lightweight face plates for use with data entry devices, modified in accordance with the teachings of the illustrative embodiments. In a preferred embodiment, the face plate 1010 is lightweight, waterproof, and shock resistant in order to survive in the rugged environment typically found in areas adjacent to an oil producing locations. In a particularly preferred embodiment, the face plate 1010 is a membrane switch type available from Nelson Nameplate Inc. In an alternative embodiment, another type of sealed switch panel may be used such as, for example, a piezo-electric switch panel may be substituted for the face plate 1010.

The first display 1015 may comprise any number of conventional commercially available lightweight display devices capable of displaying at least alpha-numeric information, modified in accordance with the teachings of the illustrative embodiments, such as, for example, LCD, vacuum fluorescent or plasma display devices. In a preferred embodiment, the first display 1015 is lightweight, waterproof, and shock resistant in order to survive in the rugged environment typically found in areas adjacent to an oil producing locations. In a particularly preferred embodiment, the first display 1015 is a 240×128 pixel back-lit liquid crystal display part no. LM 4129 available from Densitron. In an alternative embodiment, any suitable alpha-numeric display may be substituted for the first display 1015.

The second display 1020 may comprise any number of conventional commercially available lightweight display devices capable of displaying at least alphanumeric information, modified in accordance with the teachings of the illustrative embodiments, such as, for example, LCD, vacuum fluorescent, or plasma displays. In a preferred embodiment, the second display 1020 is lightweight, waterproof, and shock resistant in order to survive in the rugged environment typically found in areas adjacent to an oil producing locations. In a particularly preferred embodiment, the second display 1020 is a 240×128 pixel back-lit LCD display part no. LM 4129 available from Densitron. In an alternative embodiment, any suitable alpha-numeric display may be substituted for the second display 1020.

The first set of function keys 1025 may comprise any number of conventional commercially available data entry keypads, modified in accordance with the teachings of the illustrative embodiments, such as, for example, those manufactured by Microswitch or Grayhill. In a preferred embodiment, the first set of function keys 1025 are lightweight, waterproof, and shock resistant in order to survive in the rugged environment typically found in areas adjacent to an oil producing locations. In a particularly preferred embodiment, the first set of function keys 1025 are integral to membrane switch overlay available from Nelson Nameplate Inc. In an alternative embodiment, separate keyswitches such as, for example, commercially available switches may be substituted for the first set of function keys 1025.

In a preferred embodiment, the functionality of the first set of function keys 1025 is programmed into the system controller 210 and can be further modified during operation by the operator. These keys are preferably defined by the text in the bottom line of the first display 1015. This text changes with the control point or function being processed to redefine the function keys dynamically as required.

The general purpose keyboard 1030 may comprise any number of conventional commercially available lightweight keyboards, modified in accordance with the teachings of the illustrative embodiments such as, for example, those manufactured by Microswitch or Grayhill. In a preferred embodiment, the general purpose keyboard 1030 is lightweight, waterproof, and shock resistant in order to survive in the rugged environment typically found in areas adjacent to an oil producing locations. In a particularly preferred embodiment, the general purpose keyboard 1030 is integral to the membrane switch overlay available from Nelson Nameplate Inc. In an alternative embodiment, separate keyswitches such as, for example, commercially available switches may be substituted for the general purpose keyboard 1030.

In a preferred embodiment, each of the keys of the general purpose keyboard 1030 include one or more indicator lights to assist their use by the operator. In a particularly preferred embodiment, each of the keys 1060 of the general purpose keyboard 1030 includes three light-emitting-diode indicators (LEDs) 1062, 1064 and 1066. The circular LED 1062 is furthermore preferably yellow in color and is used to indicate that a particular function associated with the key 1060 has been activated for control by the operator. The other LEDs 1064 and 1066 are used to indicate the operational status of the device associated with the individual key.

In a particularly preferred embodiment, the LEDs 1064 and 1066 comprise red and green LEDs respectively. The red LED 1064 indicates that the associated function is off. The green LED 1066 flashes when the computer has turned a function on in the automatic mode and illuminates steady when the function is on and being controlled in the manual mode.

In a particularly preferred embodiment, each of the keys 1060 of the general purpose keyboard 1030 will be dedicated, within a particular application, to a specific control point within the blender system 100 (e.g., pumping rate, auger rate, etc . . . ). This designation is then reprogrammed by editing the resident system controller program.

The data entry keyboard 1035 may comprise any number of conventional commercially available lightweight keyboards, modified in accordance with the teachings of the illustrative embodiments, such as, for example, those manufactured by Microswitch or Grayhill. In a preferred embodiment, the data entry keyboard 1035 is lightweight, waterproof, and shock resistant in order to survive in the rugged environment typically found in areas adjacent to an oil producing locations. In a particularly preferred embodiment, the data entry keyboard 1035 is integral to the membrane switch overlay available from Nelson Nameplate Inc. In an alternative embodiment, separate keyswitches such as, for example, commercially available switches may be substituted for the data entry keyboard 1035.

In a particularly preferred embodiment, the data entry keyboard 1035 includes an indicator display 1037 positioned over the keypad that flashes each time any key on the function keypad 1025, the general purpose keyboard 1030, the data entry keyboard 1035, the special purpose keyboard and display 1040 or the function keys 1050 are pressed to furnish the operator visual feedback when operating the unit.

The special purpose keyboard and display 1040 may comprise any number of conventional commercially available lightweight keyboards, modified in accordance with the teachings of the illustrative embodiments, such as, for example, those manufactured by Microswitch or Grayhill. In a preferred embodiment, the special purpose keyboard and display 1040 is lightweight, waterproof, and shock resistant in order to survive in the rugged environment typically found in areas adjacent to an oil producing locations. In a particularly preferred embodiment, the special purpose keyboard and display 1040 is integral to the membrane switch overlay available from Nelson Nameplate Inc. In an alternative embodiment, separate keyswitches such as, for example, commercially available switches may be substituted for the special purpose keyboard and display 1040.

In a particularly preferred embodiment, the special purpose keyboard and display 1040 is positioned at the lower right hand corner of the control pendant to permit the operator to access the keys using his right thumb. The special purpose keyboard and display 1040 is further preferably programmed to control a particular function after that function has been selected by the operator using the general purpose keyboard 1030.

In a particularly preferred embodiment, the special purpose keyboard and display 1040 includes an OFF key 1068, an ON key 1070, a MAN key 1072, an AUTO key 1074, a RAPID DECR key 1076, a SLOW DECR key 1078, a SLOW INCR key 1080, a RAPID INCR key 1082, a bar graph display 1084, a down arrow display 1086, and an up arrow display 1088.

In the particularly preferred embodiment, after a control point or function has been selected by the operator using the general purpose keyboard 1030, the operator may then use the special purpose keyboard and display 1040 to control that selected control point or function. If the operator presses the AUTO key 1074, the control point or function under control goes into the auto mode. This means that the blender operation program has control of the selected control point or function.

If the operator selects the manual mode by pressing the MAN key 1072, the control point or function selected is then manually controlled by the increase and decrease keys 1076, 1078, 1080 and 1082. Two sets of keys are preferably provided to give the operator the option of two rates of increase or decrease. This allows better manual control by allowing the operator to quickly arrive near a desired setpoint and still have resolution for fine tuning.

The "ON" key 1070 activates the control point or function in whatever mode is selected. The "OFF" key 1068 unconditionally shuts off the selected control point or function.

A 20 segment LED bar graph 1084 shows the relative set point for the control point or function regardless of the selected mode. The up arrow display 1088 flashes slowly when the SLOW INCR key 1080 is pressed and flashes rapidly when the RAPID INCR key 1082 is pressed. In a particularly preferred embodiment, the up arrow display 1088 comprises a green LED. The down arrow display 1086 operates similarly when the SLOW DECR and RAPID DECR keys 1076 and 1078 are pressed. In a particularly preferred embodiment, the down arrow display 1086 is a red LED. The up arrow display 1088 and the down arrow display 1086 provide the operator with visual feedback when operating the unit.

The status display 1045 may comprise any number of conventional commercially available lightweight display devices, modified in accordance with the teachings of the illustrative embodiments, such as, for example, incandescent lamps or LEDs. In a preferred embodiment, the status display 1045 is lightweight, waterproof, and shock resistant in order to survive in the rugged environment typically found in areas adjacent to an oil producing locations. In a particularly preferred embodiment, the status display 1045 is an array of two LEDs available from any number of commercial sources.

In a preferred embodiment, the status display includes indicator displays 1090 and 1092. Illumination of the display 1090 indicates power is applied to the control pendant 240 or 250. Illumination of the display 1092 indicates that the control pendant 240 or 250 is communicating with the system controller 210.

The second set of function keys 1050 may comprise any number of conventional commercially available data entry keypads, modified in accordance with the teachings of the illustrative embodiments, such as, for example, those manufactured by Microswitch or Grayhill. In a preferred embodiment, the second set of function keys 1050 are lightweight, waterproof, and shock resistant in order to survive in the rugged environment typically found in areas adjacent to an oil producing locations. In a particularly preferred embodiment, the second set of function keys 1050 are integral to the membrane switch overlay available from Nelson Nameplate Inc. In an alternative embodiment, separate key switches such as, for example, commercially available switches may be substituted for the second set of function keys 1050.

In a preferred embodiment, the functionality of the second set of function keys 1050 is programmed into the system controller 210 can be further modified during operation by the operator. These keys are preferably defined by the text in the bottom line of the second display 1020. This text changes with the control point or function being processed to redefine the function keys dynamically as required.

The alarm display 1055 may comprise any number of conventional commercially available indicators, modified in accordance with the teachings of the illustrative embodiments. In a preferred embodiment, the alarm display 1055 is lightweight, waterproof, and shock resistant in order to survive in the rugged environment typically found in areas adjacent to an oil producing locations. In a particularly preferred embodiment, the alarm display 1055 is an array of four LEDs available from many commercial sources. In an alternative embodiment, another type of indicator such as, for example, an incandescent lamp may be substituted for the alarm display 1055.

In a preferred embodiment, the alarm display includes a plurality of indicator displays 1094. These displays 1094 are illuminated by the system controller to indicate a warning message that requires the operators attention (e.g., engine overheat, low oil pressure, etc . . . ).

Referring to FIG. 5, in a particularly preferred embodiment, the functionality of the key pads 1060 of the general purpose keyboard 1030 is identified by one or more removable keyboard legends 1105 which identify the functionality of the individual key pads. The keyboard legends may comprise any number of commercially available keypad overlays, modified in accordance with the teachings of the illustrative embodiments, such as, for example, paper or mylar. In a preferred embodiment, the keyboard legends 1105 are lightweight, waterproof, and shock resistant in order to survive in the rugged environment typically found in areas adjacent to an oil producing locations. In a particularly preferred embodiment, the keyboard legends 1105 are provided by a clear plastic material having printed legends available from Nelson Nameplate Inc. that is inserted through a slot located in the rear of the front panel 1010. This feature allows the keyboard legends to be easily changed after the control pendant 240 and 250 has been constructed thereby giving the control pendant 240 and 250 the capability of use in a number of different applications. (e.g., different styles of blenders, chemical additive units, cement blenders, etc . . . ) In an alternative embodiment, methods such as, for example, engraving may be substituted for the keyboard legends 1105.

The design of the control pendants 240 and 250 with slip-in labels for the function keys of the general purpose keyboard 1030 allows the control pendant configuration to be easily changed. This allows a standard control pendant to be used for other applications thereby reducing inventory requirements and minimizing training. The reduction in weight of the control pendants 240 and 250 further reduces the weight of the entire apparatus. This is a significant consideration for equipment built on truck frames that must meet certain weight requirements.

As also illustrated in FIG. 5, in a particularly preferred embodiment the control pendant housings 1005 will also include a lightweight yet rugged handle 1110. The handle may be fabricated from any number of strong lightweight materials such as, for example, steel, aluminum or plastic. In a preferred embodiment, the handle 1110 is fabricated from epoxy coated aluminum available from Rose Enclosures. The handle 1110 may be removable or permanently affixed to the housing 1005 using conventional methods and materials such as, for example, nuts and bolts or adhesives. In a preferred embodiment, the handle 1110 is removably affixed to the housing 1005 by conventional machine screws.

Referring to FIG. 6, in a particularly preferred embodiment, the control pendants 240 and 250 also preferably include a microcontroller with program memory 1205, communication busses 1210, 1215, 1220 and 1225, differential line driver 1230, input/output connection 1235, communication bus 1240, switch matrix 1245, communication bus 1250, light emitting diode (LED) drivers 1255, communication bus 1260, and LED indicators 1265.

The microcontroller with program memory 1205 may comprise any number of commercially available microcontrollers with program memory, modified in accordance with the teachings of the illustrative embodiments, such as, for example, those manufactured and sold by Signetics, Hitachi or Dallas Semiconductor. In a preferred embodiment, the microcontroller with program memory 1205 is a single chip Intel 87C51 microcontroller. In an alternative embodiment, another type of microcontroller such as, for example, a Motorola 68HC11 may be substituted for the microcontroller with program memory 1205.

In a particularly preferred embodiment, the primary functions of the microcontroller 1205 are controlling the first and second displays 1015 and 1020, controlling the LED indicators 1265, processing keyboard inputs by the operator, and communicating with the system controller 210.

The differential line driver 1230 may comprise any number of commercially available differential line drivers, modified in accordance with the teachings of the illustrative embodiments. In a preferred embodiment, the differential line driver 1230 is a 96176 available from Texas Instruments. In an alternative embodiment, another type of driver such as, for example, a 75176 may be substituted for the differential line driver 1230.

In a preferred embodiment, the microcontroller 1205 communicates with the system controller 210 in a conventional manner via the differential line drivers 1230 and a UART integral to the microcontroller 1205.

The switch matrix 1245 will preferably provide all of the functionality for one or more of the following: the first set of function keys 1025, general purpose keyboard 1030, the data entry keyboard 1035, special purpose keyboard 1040, and the second set of function keys 1050. The switch matrix 1245 may comprise any number of commercially available switch matrix devices, modified in accordance with the teachings of the illustrative embodiments, such as, for example, commercially available switches or keypads. In a preferred embodiment, the switch matrix 1245 is an 8×8 sealed membrane switch matrix available from Nelson Nameplate Inc. In an alternative embodiment, another commercially available switch and/or keypad assembly such as, for example, those manufactured by Microswitch may be substituted for the switch matrix 1245.

In a preferred embodiment, the microcontroller 1205 scans the switch matrix 1245 in a conventional manner to determine any operator keyboard entries. The LED drivers 1255 may comprise any number of commercially available LED drivers, modified in accordance with the teachings of the illustrative embodiments. In a preferred embodiment, the LED drivers 1255 are UNC 5832 drivers available from Sprague. In an alternative embodiment, other commercially available driver devices such as, for example, discrete transistors may be substituted for the LED drivers 1255.

The LED indicators 1265 may comprise any number of commercially available LED indicators, modified in accordance with the teachings of the illustrative embodiments. In a preferred embodiment, the LED indicators 1265 are standard T 1¾ available from Hewlet-Packard. In an alternative embodiment, incandescent lamp indicators may be substituted for the LED indicators 1265.

In a particularly preferred embodiment, the LED indicators 1265 are selected to correspond to the LED indicators previously discussed with reference to the preferred embodiments of the control pendants 240 and 250.

The input-output connection 1235 may comprise any number of commercially available input-output connections, modified in accordance with the teachings of the illustrative embodiments. In a preferred embodiment, the input-output connection 1235 is a standard military style connector available from Bendix.

The communications busses 1210, 1215, 1220, 1225, 1240, 1250 and 1260 may comprise any number of conventional serial and/or parallel communication busses with conventional supporting circuitry and software for facilitate their operation. In a preferred embodiment, the busses 1225 and 1250 are serial communication busses and the busses 1210, 1215, 1220, 1240 and 1260 are parallel communication busses.

Figure 7:
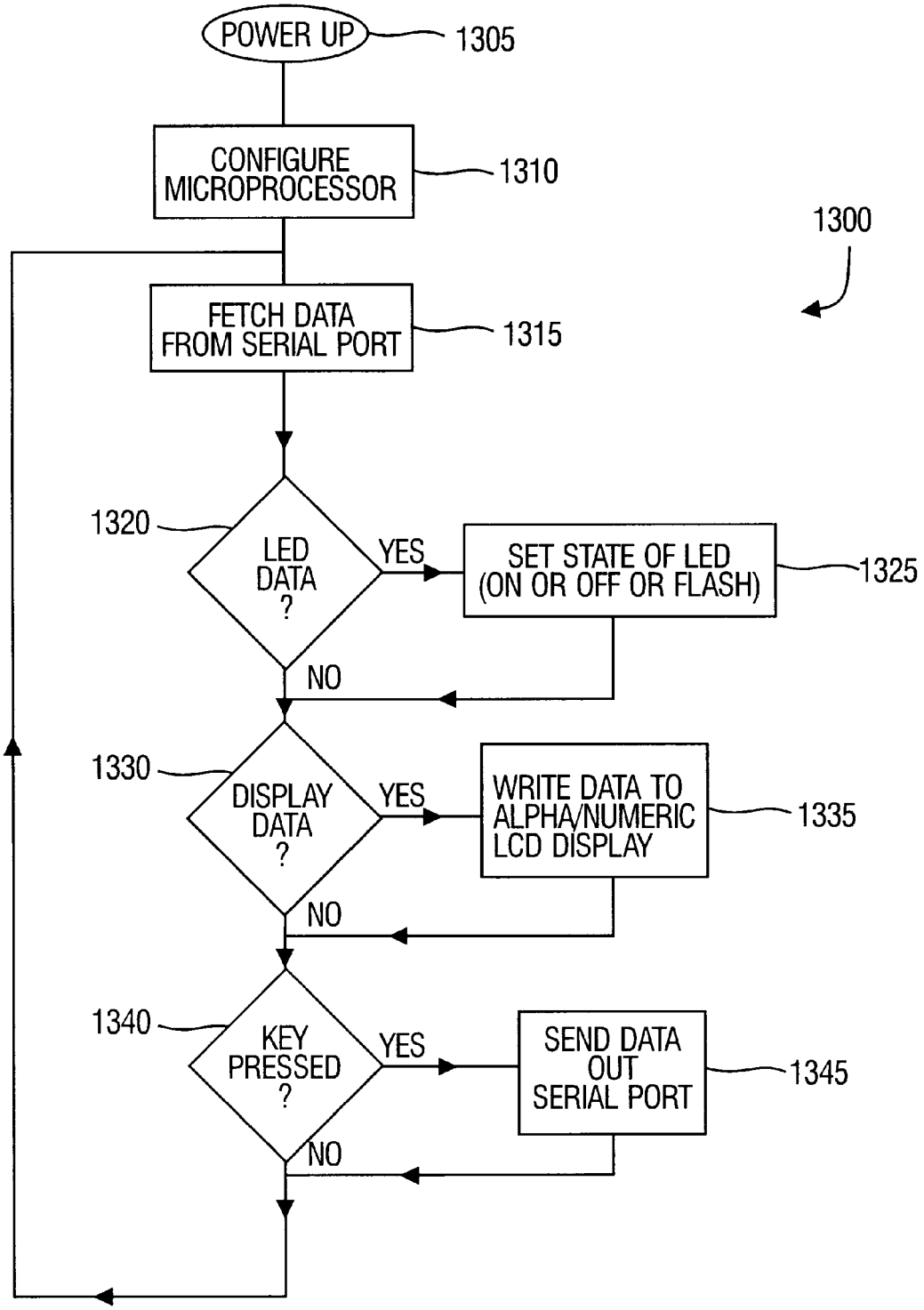
FIG. 7 is a flow diagram illustrating the operation of the control pendant used in the blender system of FIGS. 1*a*, 1*b* and 1*c*.

As illustrated in FIG. 7, in a particularly preferred embodiment the control pendants 240 and 250 are programmed to interface with the system controller 210 in accordance with a control pendant operating program 1300 resident in each of the control pendants 240 and 250. Using this operating program 1300, the control pendants 240 and 250 interface with the system controller 210 and permit operator input and control of the blender assembly 300. After powering up the control pendants 240 and 250 in program step 1305, the pendant operating program 1300 directs the control pendants 240 and 250 to configure their respective processors. The configuration of the processors will determine the operational parameters of the control pendants 240 and 250. In a preferred embodiment, the operational parameters of the control pendants 240 and 250 are variable and thereby permit the control pendants 240 and 250 to be customized for different operational requirements of different applications. In this manner, the control system 200 is a general purpose control system.

After completing the configuration of their processors in program step 1310, the control pendants 240 and 250 fetch serial data from their respective serial communication ports that has been sent from the system controller 210 in program step 1315. After completing program step 1315, the control pendants 240 and 250 check to see if the serial data retrieved in program step 1315 represents LED data in program step 1320.

If the serial data represents LED data in program step 1320, then the control pendants 240 and 250 update the state of the LED so designated in program step 1325. In a preferred embodiment, the state of an LED can be on, off, or flashing. Upon the completion of program step 1325 or if the serial data did not represent LED data in program step 1320, the control pendants 240 and 250 proceed to execute program step is 1330.

In program step 1330, the control pendants check to see if the serial data received in program step 1315 represents a change in the data displayed on one of the displays 1015, 1020 and/or 1040. If the serial data received represents a change in the data displayed on one of the displays 1015, 1020 and/or 1040, then the control pendants 240 and 250 proceed to update the displayed data in program step 1335.

After completing program step 1335 or if the data received did not represent a change in the data displayed on one of the displays 1015, 1020 and/or 1040 in program step 1330, the control pendants 240 and 250 proceed to execute program step 1340. In program step 1340, the control pendants 240 and 250 check to see if any keys have been pressed on the control pendants 240 and 250 by an operator. If any keys have been pressed, then the respective control pendant 240 or 250 then executes program step 1345 and sends the data represented by the pressed key out the serial port to the system controller 210.

If no keys have been pressed in program step 1340 or upon the completion of program step 1345, the control pendants loop back to program step 1315.

The blending assembly 300 preferably includes a source of gelled fracturing fluid assembly 305, an electronically controlled engine assembly 310, a centrifugal pump driven by a variable speed hydraulic motor assembly 315, a first magnetic flow meter assembly 320, a first turbine flow meter assembly 325, first, second and third liquid additive assemblies 330*a*, 330*b* and 330*c*, a first pressure sensor assembly 335, a first electrically operated flow control valve assembly 340, a second electrically operated flow control valve assembly 345, a blending tub assembly 350, first and second dry additive assemblies 355*a* and 355*b*, first and second proppant additive assemblies 520*a* and 520*b*, a third electrically operated valve assembly 365, a second pressure sensor assembly 370, a second magnetic flow meter assembly 375, a second turbine flow meter assembly 380, and a densimeter assembly 385.

The source of gelled fracturing fluid assembly 305 may include any number of conventional commercially available gelled fracturing fluids, modified in accordance with the teachings of the illustrative embodiments. In a preferred embodiment, the source of gelled fracturing fluid assembly 305 uses one of several commercially available fluids available from BJ Services of Houston, Tex. The source of fracturing fluid assembly 305 may be contained with a conventional commercially available storage device, modified in accordance with the teachings of the illustrative embodiments, such as, for example, commercially available tanks specifically designed to contain pre-mixed gelled fluids. In an alternative embodiment, the source of fracturing fluid assembly 305 may be a continuous "on-the-fly" gelling system.

The electronically controlled engine assembly 310 comprise any number of conventional commercially available engines having feedback control and sensing, modified in accordance with the teachings of the illustrative embodiments, such as, for example, a Detroit Diesel or Cummings engine. In a preferred embodiment, the electronically controlled engine assembly 310 is a model no. 3406E engine available from Caterpillar having an integral electronic throttle control. In an alternative embodiment, a commercially available engine without integral electronic controls such as those manufactured and sold by Detroit Diesel may be substituted for the electronically controlled engine assembly 310.

In a preferred embodiment, during operation of the electronically controlled engine assembly 310, a serial engine data signal 390 is transmitted from the electronically controlled engine assembly 310 to the system controller 210 and a throttle control signal 395 is transmitted from the system controller 210 to the electronically controlled engine assembly 310. In this manner, the system controller 210 is able to control the operation of the electronically controlled engine assembly 310 using any number of conventional control algorithms.

The serial engine data signal 390 may include one or more of the following operational parameters engine RPM, oil pressure, water temperature, battery voltage, percent throttle, fuel consumption rate, etc . . . In a preferred embodiment, the serial engine data signal 390 includes the operational parameters of engine status, power-take-off (PTO) status, PTO oil temperature, percent throttle, percent engine load, fuel delivery pressure, engine oil pressure, boost pressure, turbo oil pressure, intake manifold temperature, engine coolant pressure, battery voltage, fuel temperature, engine oil temperature, turbo oil temperature, fuel rate and engine RPM. The serial engine data signal 390 may be transmitted according to any number of conventional serial data transmission protocols such as, for example, ASCII format. In a preferred embodiment, the serial engine data signal 390 is transmitted using the SAE J1708 and SAE J1587 serial data communications protocols. The throttle control signal 395 may be transmitted according to any number of conventional data transmission protocols such as, for example, 4–20 mA analog or serial digital data formats. In a preferred embodiment, the throttle control signal 395 is transmitted using a pulse-width-modulated 12 volt signal data communications protocol that is accepted by the Caterpillar engine 310.

The centrifugal pump driven by a variable speed motor assembly 315 may comprise any number of conventional commercially available centrifugal pumps driven by a variable speed motor and controlled by a servo valve and having a motor speed sensor, modified in accordance with the teachings of the illustrative embodiments. In a preferred embodiment, the centrifugal pump driven by a variable speed motor assembly 315 is a Gould centrifugal pump available from Gould driven by a hydrostatic variable speed motor available from Sundstrand controlled by a Sundstrand servo valve available from Sundstrand and utilizing a magnetic motor speed sensor part no. KPP available from Sundstrand. In a particularly preferred embodiment, the centrifugal pump driven by a variable speed motor assembly 315 is in turn driven by the electronically controlled engine 310 using a conventional power transmission device. In an alternative embodiment, another device such as a fixed speed pump coupled to a flow control valve may be substituted for the centrifugal pump driven by a variable speed motor assembly 315.

In a preferred embodiment, during operation of the centrifugal pump driven by a variable speed motor assembly 315, a speed signal from the hydraulic motor 400 is transmitted from the centrifugal pump driven by a variable speed motor assembly 315 to the system controller 210 and a drive signal to the hydraulic motor 405 is transmitted from the system controller 210 to the centrifugal pump driven by a variable speed motor assembly 315. In this manner, the system controller 210 is able to control the operation of the centrifugal pump driven by a variable speed hydraulic motor assembly 315 using any number of conventional control algorithms. In a preferred embodiment, the system controller 210 controls the speed of the hydraulic motor by transmitting pulse-width-modulated (PWM) control signal to the servo valve that controls the flow of motive fluid to the hydraulic motor.

The speed signal from the hydraulic motor 400 may be transmitted according to any number of conventional data transmission protocols. In a preferred embodiment, the speed signal from the hydraulic motor 400 is transmitted using a frequency signal proportional to speed communications protocol. The drive signal to the hydraulic motor 405 may be transmitted according to any number of conventional data transmission protocols such as, for example, an analog signal to control servo valve displacement. In a preferred embodiment, the drive signal to the hydraulic motor 405 is transmitted using a pulse width modulated drive signal communications protocol.

The first magnetic flow meter assembly 320 may comprise any number of conventional commercially available magnetic flow meter assemblies, modified in accordance with the teachings of the illustrative embodiments. In a preferred embodiment, the first magnetic flow meter assembly 320 is a model 8705 available from Rosemount Electronics. In an alternative embodiment, another commercially available magnetic flow meter such as those manufactured and sold by Yokagawa, Foxboro or Fisher-Porter may be substituted for the first magnetic flow meter assembly 320.

In a preferred embodiment, during operation of the first magnetic flow meter assembly 320, a first suction flow signal 410 is transmitted from the first magnetic flow meter assembly 320 to the system controller 210. In this manner, the system controller 210 is able to monitor the flow rate of the fluid mixture passing through the first magnetic flow meter assembly 320 and then control the operation of other devices within the blender assembly accordingly using any number of conventional control algorithms.

The first suction flow signal 410 may be transmitted according to any number of conventional data transmission protocols such as, for example, a 4–20 mA analog signal or a Hart buss protocol. In a preferred embodiment, the first suction flow signal 410 is transmitted using a variable frequency signal proportionate to flow rate data communications protocol.

The first turbine flow meter assembly 325 may comprise any number of conventional commercially available turbine flow meter assemblies, modified in accordance with the teachings of the illustrative embodiments. In a preferred embodiment, the first turbine flow meter assembly 325 is a standard impeller type turbine meter available from Electronic Data Devices, Inc. In an alternative embodiment, a commercially available turbine flow meter such as those manufactured and sold by Tejas Inc. or Hoffer Flow Controls may be substituted for the first turbine flow meter assembly 325.

In a preferred embodiment, during operation of the first turbine flow meter assembly 325, a second suction flow signal 415 is transmitted from the first turbine flow meter assembly 325 to the system controller 210. In this manner, the system controller 210 is able to monitor the flow rate of the fluid mixture passing through the first turbine flow meter assembly 325 and then control the operation of other devices within the blender assembly accordingly using any number of conventional control algorithms.

The second suction flow signal 415 may be transmitted according to any number of conventional data transmission protocols such as, for example, a 4–20 mA analog signal or a Hart Buss protocol. In a preferred embodiment, the second suction flow signal 415 is transmitted using a variable frequency signal proportionate to flow rate data communications protocol.

The first, second and third liquid additive assemblies 330*a*, 330*b* and 330*c* include first, second and third source of fluid additive assemblies 420*a*, 420*b* and 420*c*, first, second and third positive displacement additive pumps driven by variable speed hydraulic motors assemblies 425*a*, 425*b* and 425*c*, and first, second and third mass flow meters assemblies 430*a*, 430*b* and 430*c*, and first, second and third liquid additive flow control valves assemblies 435*a*, 435*b* and 435*c*.

The first, second and third sources of liquid additive assemblies 420*a*, 420*b* and 420*c* may include any number of conventional commercially available liquid fracturing and propping fluid additives, modified in accordance with the teachings of the illustrative embodiments, such as, for example, a crosslinker or breaker fluid. In a preferred embodiment, the first, second and third sources of liquid additive assemblies 420*a*, 420*b* and 420*c* use a variety of chemical additives specific to each individual treatment available from BJ Services of Houston, Tex. The first, second and third source of liquid additive assemblies 420*a*, 420*b* and 420*c* may be contained with conventional commercially available storage devices, modified in accordance with the teachings of the illustrative embodiments, such as, for example, storage tanks fabricated from metal or plastic materials. In a preferred embodiment, the first, second and third source of liquid additives 420*a*, 420*b* and 420*c* are housed within plastic tanks available from a variety of commercial sources.

The first, second and third positive displacement additive pumps driven by variable speed hydraulic motors assemblies 425*a*, 425*b* and 425*c* may comprise any number of conventional commercially available positive displacement pumps driven by a variable speed hydraulic motor controlled by a servo valve and having a motor speed sensor, modified in accordance with the teachings of the illustrative embodiments. In a II preferred embodiment, the first, second and third positive displacement additive pumps driven by variable speed hydraulic motors assemblies 425*a*, 425*b* and 425*c* include a Bertolini positive displacement pump available from Bertolini driven by a TRW Ross, Inc. variable speed hydraulic motor available from TRW Ross, Inc. controlled by a Sundstrand servo valve available from Sundstrand and having a magnetic motor speed sensor integral to the hydraulic motor. In a particularly preferred embodiment, the first, second and third positive displacement additive pumps driven by variable speed hydraulic motors assemblies 425*a*, 425*b* and 425*c* are in turn driven by the electronically controlled engine 310 using a conventional power transmission device.

The first, second and third mass flow meters 430*a*, 430*b* and 430*c* may comprise any number of conventional commercially available mass flow meters, modified in accordance with the teachings of the illustrative embodiments. In a preferred embodiment, the first, second and third mass flow meters 430*a*, 430*b* and 430*c* are model "D" mass flow meters available from Micromotion, Inc.

The first, second and third liquid additive flow control valves 435*a*, 435*b* and 435*c* may comprise any number of conventional commercially available flow control valves, modified in accordance with the teachings of the illustrative embodiments. In an alternative embodiment, the first, second and third flow control valves 435*a*, 435*b* and 435*c* may be omitted.

In a preferred embodiment, during operation of the first, second and third liquid additive assemblies 330*a*, 330*b* and 330*c*, first, second and third speed signals from the hydraulic motors 440*a*, 440*b* and 440*c* are transmitted from the first, second and third positive displacement pump driven by a variable speed hydraulic motor assemblies 425*a*, 425*b* and 425*c* to the system controller 210. The first, second and third drive signals to the servo valves that control the hydraulic motors 445*a*, 445*b* and 445*c* are transmitted from the system controller 210 to the positive displacement pump driven by a variable speed hydraulic motor assemblies 425*a*, 425*b* and 425*c*. The first, second and third additive flow rate signals 450*a*, 450*b* and 450*c* are transmitted from the first, second and third mass flow meter assemblies 430*a*, 430*b* and 430*c* to the system controller 210. The first, second and third liquid additive flow control signals 455*a*, 455*b* and 455*c* are transmitted to the first, second and third liquid additive flow control valves 435*a*, 435*b* and 435*c* from the system controller 210. In this manner, the system controller 210 is able to control the operation of the first, second and third liquid additive assemblies 330*a*, 330*b* and 330*c* using any number of conventional control algorithms. In a preferred embodiment, the system controller 210 controls the speed of the hydraulic motors by transmitting pulse-width-modulated (PWM) control signals to the servo valves that control the flow of motive fluid to the hydraulic motors.

The speed signals from the hydraulic motors 440*a*, 440*b*, and 440*c*, the drive signals to the hydraulic motors 445*a*, 445*b* and 445*c*, the additive flow rate signals 450*a*, 450*b* and 450*c*, and the liquid additive flow control valve signals 455*a*, 455*b* and 455*c* may be transmitted according to any number of conventional data transmission protocols such as, for example, a 4–20 mA analog signal. In a preferred embodiment, the speed signals from the hydraulic motors 440*a*, 440*b*, and 440*c*, the drive signals to the hydraulic motors 445*a*, 445*b* and 445*c*, the additive flow rate signals 450*a*, 450*b* and 450*c*, and the liquid additive flow control valve signals 455*a*, 455*b* and 455*c* are transmitted as variable frequency 12 volt signals.

The first pressure sensor assembly 335 may comprise any number of conventional commercially available pressure sensor assemblies, modified in accordance with the teachings of the illustrative embodiments, such as, for example, a strain gauge or bourdon tube. In a preferred embodiment, the first pressure sensor assembly 335 is a strain gauge available from Viatran, Inc. In an alternative embodiment, other commercially available strain gauges such as those manufactured and sold by Sensotec may be substituted for the first pressure sensor assembly 335.

In a preferred embodiment, during operation of the first pressure sensor assembly 335, a first pressure signal 460 is transmitted from the first pressure sensor assembly 335 to the system controller 210. In this manner, the system controller 210 is able to monitor the pressure the fluid mixture passing adjacent to the first pressure sensor assembly 335 and then control the operation of other devices within the blender assembly 300 accordingly using any number of conventional control algorithms.

The first pressure signal 460 may be transmitted according to any number of conventional data transmission protocols such as, for example, a 4–20 mA analog signal, a variable frequency signal or a varying voltage signal. In a preferred embodiment, the first pressure signal 460 is transmitted using a 4–20 mA analog signal.

Figure 1B:
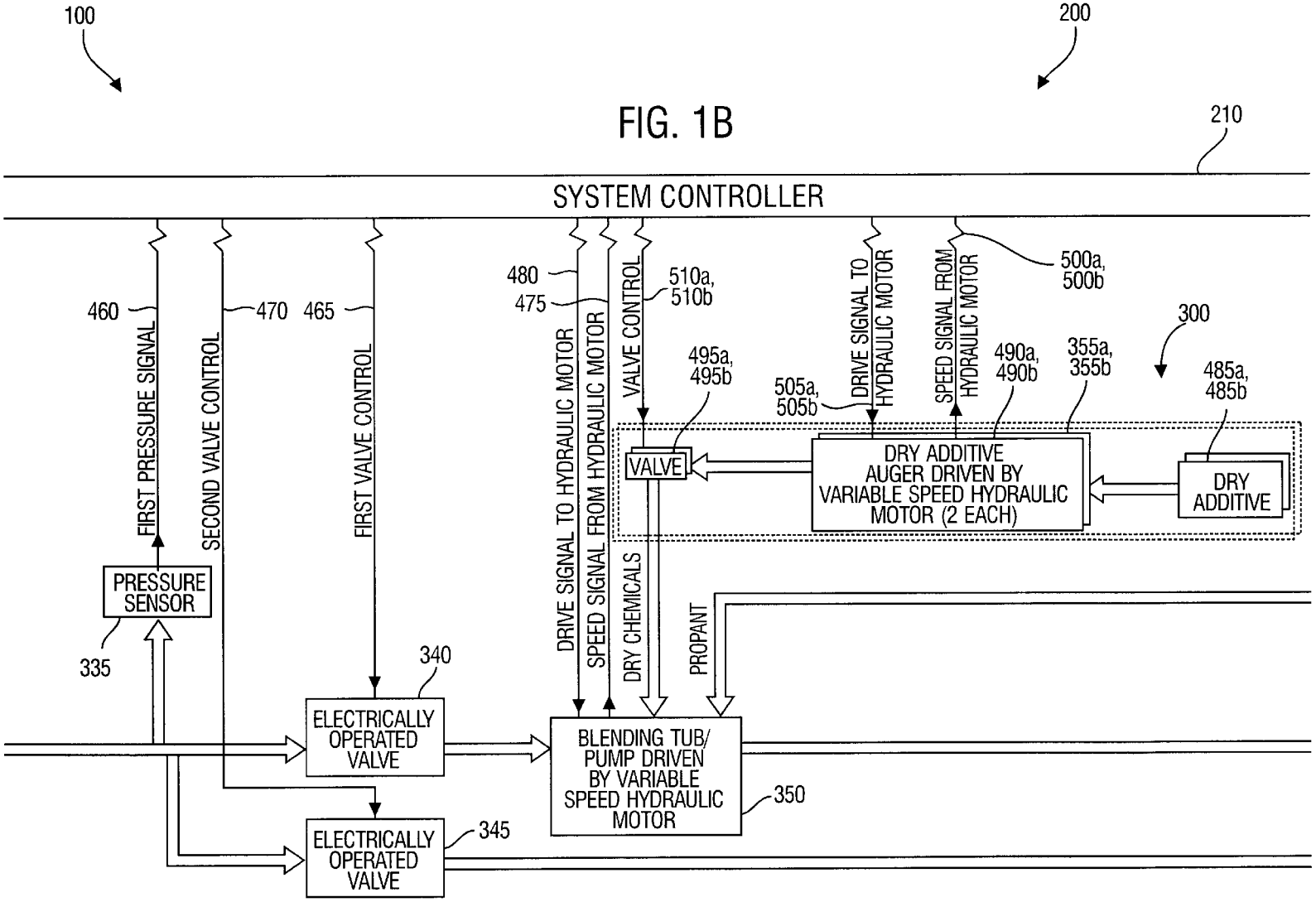
Figure 1C:
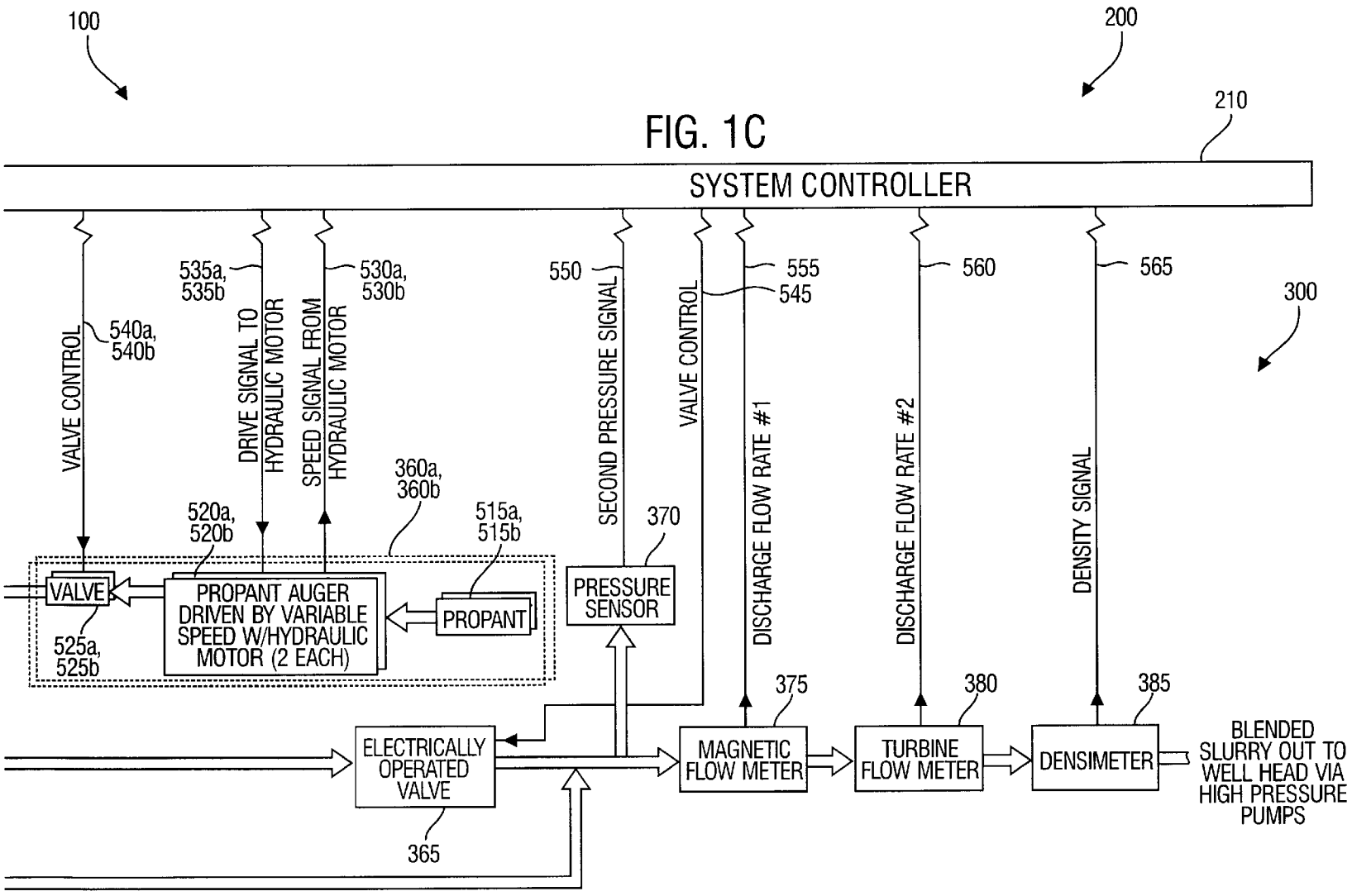

In a preferred embodiment, fracturing fluid is drawn from the source of gelled fracturing fluid 305 by the centrifugal pump driven by a variable speed hydraulic motor assembly 315 in the direction indicated by the arrows in the FIGS. 1*a*, 1*b* and 1*c*. In the preferred embodiment, the speed of the motor that drives the centrifugal pump assembly 315 is controlled by the system controller 210 as a function of the first pressure signal 460 to control the pressure at which the gelled fracturing fluid is introduced into the blender tub assembly 350.

The first electrically operated flow control valve assembly 340 may comprise any number of conventional commercially available flow control valve assemblies, modified in accordance with the teachings of the illustrative embodiments, such as, for example, a butterfly valve, a gate valve or a ball valve. In a preferred embodiment, the first electrically operated flow control valve assembly 340 is a butterfly valve available from Dover Norris, Inc.. In an alternative embodiment, any other type of flow control valve such as a gate or ball valve may be substituted for the first electrically operated flow control valve assembly 340.

In a preferred embodiment, during operation of the first electrically operated flow control valve assembly 340, a first valve control signal 465 is transmitted from the system controller 210 to first electrically operated flow control valve assembly 340. In this manner, the system controller 210 is able to control the flow of the fluid mixture passing through the first electrically operated flow control valve assembly 340, either mapually or according to any number of conventional control algorithms.

The first valve control signal 465 may be transmitted according to any number of conventional data transmission protocols such as, for example, industry standard serial data protocols. In a preferred embodiment, the first valve control signal 465 is transmitted using an on/off 12 volt signal.

The second electrically operated flow control valve assembly 345 may comprise any number of conventional commercially available flow control valve assemblies, modified in accordance with the teachings of the illustrative embodiments, such as, for example, a butterfly valve, gate valve or ball valve. In a preferred embodiment, the second electrically operated flow control valve assembly 345 is a butterfly valve available from Dover Norris, Inc. In an alternative embodiment, other commercially available valves such as gate valves or ball valves may be substituted for the second electrically operated flow control valve assembly 345.

In a preferred embodiment, during operation of the second electrically operated flow control valve assembly 345, a second valve control signal 470 is transmitted from the system controller 210 to the second electrically operated flow control valve assembly 345. In this manner, the system controller 210 is able to control the flow of the fluid mixture passing through the second electrically operated flow control valve assembly 345, either manually or according to any number of conventional control algorithms.

The second valve control signal 470 may be transmitted according to any number of conventional data transmission protocols such as, for example, industry standard serial data protocols. In a preferred embodiment, the second valve control signal 470 is transmitted using a 12 volt on/off signal.

The blending tub assembly 350 includes a tub including an integral mixing pump (not illustrated), a blending tub inlet, a blending tub outlet, and a plurality of additive inlets to permit the introduction of dry additives and proppants.

The mixing pump used in the blending tub assembly 350 is integral to the blending tub assembly 350 and is driven by a variable speed hydraulic motor controlled by a servo valve and having a motor speed sensor, modified in accordance with the teachings of the illustrative embodiments. In a preferred embodiment, the blending tub assembly 350 with the integral mixing pump is provided substantially in accordance with that disclosed in U.S. Pat. No. 4,239,396, the disclosure of which is incorporated herein by reference.

In a particularly preferred embodiment, the blending tub assembly 350 with the integral mixing pump is provided substantially in accordance with that disclosed in U.S. Pat. No. 4,239,396 and is commercially available from BJ Services of Houston, Tex. The mixing impeller of the particularly preferred embodiment is driven by a hydrostatic variable speed hydraulic motor available from Rexroth Controls, Inc. controlled by a Sundstrand servo valve available from Sundstrand and including a magnetic motor speed sensor part no. 58406 available from Electro, Inc. The impeller facilitates agitation of the mixture of the fracturing fluid with the proppant. In a particularly preferred embodiment, the mixing pump is in turn driven by the electronically controlled engine 310 using a conventional power transmission device.

In a preferred embodiment, during operation of the blending tub assembly 350, a speed signal from the hydraulic motor that drives the mixing pump 475 is transmitted to the system controller 210 and a drive signal to the hydraulic motor that drives the mixing pump 480 is transmitted from the system controller 210. In this manner, the system controller 210 is able to control the operation of the blending tub assembly 350 using any number of conventional control algorithms. In a preferred embodiment, the system controller 210 controls the speed of the hydraulic motor by transmitting a pulse-width-45 modulated (PWM) control signal to the servo valve that controls the flow of motive fluid to the hydraulic motor.

The speed signal from the hydraulic motor that drives the mixing pump 475 and the drive signal to the mixing pump 480 may be transmitted according to any number of conventional data transmission protocols. In a preferred embodiment, the speed signal from the hydraulic motor that drives the mixing pump 475 is transmitted using a frequency proportional to speed signal. In a preferred embodiment, the drive signal to the hydraulic motor that drives the mixing pump 480 is transmitted using a pulse-width-modulated signal.

The first and second dry additive assemblies 355*a* and 355*b* include first and second sources of dry additive assemblies 485*a* and 485*b*, first and second dry additive augers driven by variable speed hydraulic motors assemblies 490*a* and 490*b*, and first and second dry additive flow control valve assemblies 495*a* and 495*b*.

The first and second sources of dry additive assemblies 485*a* and 485*b* may include any number of conventional commercially available dry fracturing and propping additives, modified in accordance with the teachings of the illustrative embodiments, such as, for example, a breaker. In a preferred embodiment, the first and second sources of dry additives assemblies 485*a* and 485*b* use any number of commercially dry chemicals as determined on an individual basis as appropriate to a given treatment available from BJ Services of Houston, Tex. The first and second sources of dry additives assemblies 485*a* and 485*b* may be contained within conventional commercially available storage devices, modified in accordance with the teachings of the illustrative embodiments. In a preferred embodiment, the first and second sources of dry additives 485*a* and 485*b* are housed within a fabricated hopper capable of efficient and reliable delivery of dry additives.

The first and second dry additive augers driven by variable speed hydraulic motors assemblies 490*a* and 490*b* may comprise any number of conventional commercially available dry material augers driven by a variable speed hydraulic motor controlled by a servo valve and including a motor speed sensor, modified in accordance with the teachings of the illustrative embodiments. In a preferred embodiment, the first and second dry additive augers driven by variable speed hydraulic motors assemblies 490*a* and 490*b* include screw-type augers having a BJ Services part number 57946-1 and driven by a TRW Ross, Inc. variable speed hydraulic motor available from TRW Ross, Inc. controlled by a Sundstrand servo valve available from Sundstrand and including a magnetic motor speed sensor integral to the hydraulic motor available from TRW Ross, Inc. In a particularly preferred embodiment, the first and second dry additive augers driven by variable speed hydraulic motors assemblies 490*a* and 490*b* are in turn driven by the electronically controlled engine 310 using a conventional power transmission device.

The first and second dry additive flow control valves 495*a* and 495*b* may comprise any number of conventional commercially available flow control valves, modified in accordance with the teachings of the illustrative embodiments. In an alternative embodiment, the first and second dry additive flow control valves 495*a* and 495*b* may be omitted.

In a preferred embodiment, during operation of the first and second dry additive assemblies 355*a* and 355*b*, first and second speed signals from the hydraulic motors that drive the dry augers 500*a* and 500*b* are transmitted from the first and second dry additive auger driven by variable speed hydraulic motor assemblies 490*a* and 490*b* to the system controller 210. First and second drive signals to the servo valves that control the hydraulic motors that drive the dry augers 505*a* and 505*b* are transmitted from the system controller 210. First and second dry additive flow control signals 510*a* and 510*b* are transmitted to the first and second dry additive flow control valves 495*a* and 495*b* from the system controller 210. In this manner, the system controller 210 is able to control the operation of the first and second dry additive assemblies 355*a* and 355*b* using any number of conventional control algorithms. In a preferred embodiment, the system controller 210 precisely controls the concentration of dry additives in the fluid mixture by controlling the speed of the hydraulic motors that drive the dry additive auger assemblies 490*a* and 490*b* according to a predefined schedule. In a preferred embodiment, the system controller 210 controls the speed of the hydraulic motors by transmitting pulse-width-modulated (PWM) control signals 505*a* and 505*b* to the servo valves that control the flow of motive fluid to the hydraulic motors.

The speed signals from the hydraulic motors that drive the dry augers 500*a* and 500*b*, the drive signals to the servo valves that control the hydraulic motors that drive the dry augers 505*a* and 505*b*, and the dry additive flow control valve signals 510*a* and 510*b* may be transmitted according to any number of conventional data transmission protocols such as, for example, a 4–20 mA analog signal or industry standard serial data protocols. In a preferred embodiment, the speed signals from the hydraulic motors that drive the dry augers 500*a* and 500*b*, are transmitted using a variable frequency signal whose frequency is proportional to motor speed. The drive signal to the servo valves that control the hydraulic motors that drive the dry augers 505*a* and 505*b*, and the dry additive flow control valve signals 510*a* and 510*b* are pulse-width-modulated signals. The first and second proppant additives assemblies 360*a* and 360*b* include first and second sources of proppant assemblies 515*a* and 515*b*, first and second proppant additive augers driven by variable speed hydraulic motors assemblies 520*a* and 520*b*, and first and second proppant flow control valve assemblies 525*a* and 525*b*.

The first and second sources of proppant assemblies 515*a* and 515*b* may include any number of conventional commercially available proppants, modified in accordance with the teachings of the illustrative embodiments, such as, for example, sand. In a preferred embodiment, the first and second sources of proppant assemblies 515*a* and 515*b* use various types of proppants available from BJ Services of Houston, Tex. The first and second sources of proppant assemblies 515*a* and 515*b* may be contained within conventional commercially available storage devices, modified in accordance with the teachings of the illustrative embodiments, such as, for example, an open hopper.

The first and second proppant augers driven by variable speed hydraulic motors assemblies 520*a* and 520*b* may comprise any number of conventional commercially available dry material augers driven by a variable speed hydraulic motor having a speed sensor and controlled by a servo valve, modified in accordance with the teachings of the illustrative embodiments. In a preferred embodiment, the first and second proppant augers driven by variable speed hydraulic motors assemblies 520*a* and 520*b* include screw-type augers having a BJ Services part number 57822-1 and driven by a Rotary Power variable speed hydraulic motors available from Rotary Power, Inc. having an optical encoder available from BEI Inc. and controlled by a Sundstrand servo valve available from Sundstrand. In a particularly preferred embodiment, the first and second proppant augers driven by variable speed hydraulic motors assemblies 520*a* and 520*b* are in turn driven by the electronically controlled engine 310 using a conventional power transmission device.

The first and second proppant flow control valves 525*a* and 525*b* may comprise any number of conventional commercially available flow control valves, modified in accordance with the teachings of the illustrative embodiments. In an alternative embodiment, the first and second proppant flow control valves 525*a* and 525*b* may be omitted.

In a preferred embodiment, during operation of the first and second proppant additive assemblies 360*a* and 360*b*, first and second speed signals from the hydraulic motors that drive the proppant augers 530*a* and 530*b* are transmitted from the first and second proppant augers driven by a variable speed hydraulic motor assemblies 520*a* and 520*b* to the system controller 210. First and second drive signals to the servo valves that control the hydraulic motors that drive the proppant augers 535*a* and 535*b* are transmitted from the system controller 210. First and second proppant additive flow control signals 540*a* and 540*b* are transmitted to the first and second dry additive flow control valves 525*a* and 525*b* from the system controller 210. In this manner, the system controller 210 is able to control the operation of the first and second proppant additive assemblies 360*a* and 360*b* using any number of conventional control algorithms. In a preferred embodiment, the concentration of sand introduced into the fracturing fluid within the blending tub assembly 350 is precisely controlled by the system controller 210 according to a predefined schedule by controlling the speed of the variable speed hydraulic motors that drive the augers. In a preferred embodiment, the system controller 210 controls the speed of the hydraulic motors by transmitting pulse-width-modulated (PWM) control signals to the servo valves that control the flow of motive fluid to the hydraulic motors. The speed signals from the hydraulic motors that drive the proppant augers 530*a* and 530*b*, the drive signals to the servo valves that control the hydraulic motors that drive the proppant augers 535*a* and 535*b*, and the proppant additive flow control valve signals 540*a* and 540*b* may be transmitted according to any number of conventional data transmission protocols such as, for example, a 4–20 mA analog signal or an industry standard serial data signal. In a preferred embodiment, the speed signals from the hydraulic motors that drive the proppant augers 530*a* and 530*b*, and the proppant additive flow control valve signals 540*a* and 540*b* are transmitted using a variable frequency signal whose frequency is proportional to motor speed. In a preferred embodiment, the drive signals to the servo valves that control the hydraulic motors that drive the proppant augers 535*a* and 535*b* are pulse-width-modulated signals.

In a preferred embodiment, the flow rate into the blender tub assembly 350 is controlled by the system controller 210 by monitoring the first suction flow rate signal 410 and the second suction flow rate signal 415. The rate of introduction of the liquid additives, dry additives and proppant are then proportioned to the fracturing fluid flow rate according to a predefined schedule.

The third electrically operated flow control valve assembly 365 may comprise any number of conventional commercially available flow control valve assemblies, modified in accordance with the teachings of the illustrative embodiments, such as, for example, a butterfly valve, a gate valve or a ball valve. In a preferred embodiment, the third electrically operated flow control valve assembly 365 is a butterfly valve available from Dover Norris, Inc. In an alternative embodiment, other types of flow control valves such as gate valves or ball valves may be substituted for the third electrically operated flow control valve assembly 365.

In a preferred embodiment, during operation of the third electrically operated flow control valve assembly 365, a third valve control signal 545 is transmitted from the system controller 210 to the third electrically operated flow control valve assembly 365. In this manner, the system controller 210 is able to control the flow of the fluid mixture passing through the third electrically operated flow control valve assembly 365, either manually or according to any number of conventional control algorithms.

The third valve control signal 545 may be transmitted according to any number of conventional data transmission protocols such as, for example, industry standard serial data protocols. In a preferred embodiment, the third valve control signal 545 is transmitted using a 12 volt on/off signal.

The second pressure sensor assembly 370 may comprise any number of conventional commercially available pressure sensor assemblies, modified in accordance with the teachings of the illustrative embodiments, such as, for example, a strain gauge or a bourdon tube. In a preferred embodiment, the second pressure sensor assembly 370 is a strain gauge available from Viatran, Inc. In an alternative embodiment, several other commercially available pressure sensors such as those manufactured and sold by Sensotec may be substituted for the second pressure sensor assembly 370.

In a preferred embodiment, during operation of the second pressure sensor assembly 370, a second pressure signal 550 is transmitted from the second pressure sensor assembly 370 to the system controller 210. In this manner, the system controller 210 is able to monitor the pressure the fluid mixture passing adjacent to the second pressure sensor assembly 370 and then control the operation of other devices within the blender assembly 300 accordingly using any number of conventional control algorithms.

The second pressure signal 550 may be transmitted according to any number of conventional data transmission protocols such as, for example, a 4–20 mA analog signal, a variable frequency signal or a variable voltage signal. In a preferred embodiment, the second pressure signal 550 is transmitted using a 4–20 mA analog signal.

The second magnetic flow meter assembly 375 may comprise any number of conventional commercially available magnetic flow meter assemblies, modified in accordance with the teachings of the illustrative embodiments. In a preferred embodiment, the second magnetic flow meter assembly 375 is a model 8705 magnetic flow meter available from Rosemount Electronics. In an alternative embodiment, other commercially available magnetic flow meters such as those manufactured and sold by Yokagawa, Foxboro or Fisher-Porter may be substituted for the second magnetic flow meter assembly 375.

In a preferred embodiment, during operation of the second magnetic flow meter assembly 375, a first discharge flow signal 555 is transmitted from the second magnetic flow meter assembly 375 to the system controller 210. In this manner, the system controller 210 is able to monitor the flow rate of the fluid mixture passing through the second magnetic flow meter assembly 375 and then control the operation of other devices within the blender assembly 300 accordingly using any number of conventional control algorithms.

The first discharge flow signal 555 may be transmitted according to any number of conventional data transmission protocols such as, for example, a 4–20 mA analog signal or a Hart buss communication protocol. In a preferred embodiment, the first discharge flow signal 555 is transmitted using a variable frequency signal whose frequency is proportional to flow rate.

The second turbine flow meter assembly 380 may comprise any number of conventional commercially available turbine flow meter assemblies, modified in accordance with the teachings of the illustrative embodiments. In a preferred embodiment, the second turbine flow meter assembly 380 is a standard impeller type turbine flow meter available from Electronic Data Devices. In an alternative embodiment, other commercially available turbine flow meters such as those manufactured by Tejas, Inc. or Hoffer Controls, Inc. may be substituted for the second turbine flow meter assembly 380.

In a preferred embodiment, during operation of the second turbine flow meter assembly 380, a second discharge flow signal 560 is transmitted from the second turbine flow meter assembly 380 to the system controller 210. In this manner, the system controller 210 is able to monitor the flow rate of the fluid mixture passing through the second turbine flow meter assembly 380 and then control the operation of other devices within the blender assembly 300 accordingly using any number of conventional control algorithms. In a preferred embodiment, the system controller 210 further controls the introduction of liquid additives, dry additives and proppant as a function of the first discharge flow rate signal 555 and the second discharge flow rate signal 560 according to a predefined schedule.

The second discharge flow signal 560 may be transmitted according to any number of conventional data transmission protocols such as, for example, a 4–20 mA analog signal or Hart buss protocol. In a preferred embodiment, the second discharge flow signal 560 is transmitted using a variable frequency signal whose frequency is proportional to flow rate.

The densimeter assembly 385 may comprise any number of conventional commercially available densimeter assemblies, modified in accordance with the teachings of the illustrative embodiments, such as, for example, a "U" tube or a mass flow correolis instrument. Preferably the densimeter 385 is a nuclear device connected to the high pressure piping prior to slurry injection into the well. In a preferred embodiment, the densimeter assembly 385 is a densimeter available from Texas Nuclear, Inc.

In a preferred embodiment, during operation of the densimeter assembly 385, a density signal 565 representative of the density of proppant within the fluid mixture is transmitted from the densimeter 385 to the system controller 210. In this manner, the system controller 210 is able to monitor the proppant density within the fluid mixture passing adjacent to the densimeter 385 and then control the operation of other devices within the blender assembly 300 accordingly using any number of conventional control algorithms.

In a preferred embodiment, the densimeter 385 provides a measurement of the concentration of proppant in the slurry via the density signal 565. This information is then processed by the system controller 210 to verify the proppant concentration, calibrate the system controller 210, and is also transmitted to the remote monitor 230 and control pendants 240 and 250.

The density signal 565 may be transmitted according to any number of conventional data transmission protocols such as, for example, a 4–20 mA analog signal or a variable frequency signal. In a preferred embodiment, the density signal 565 is transmitted using a 0–10 volt analog signal.

In a preferred embodiment, the blender assembly 300 will further include one or more separate emergency stop buttons (not illustrated) and one or more separate power take-off (PTO) switches (not illustrated) in addition to the functionality provided by the control pendants 240 and 250 in order to provide an extra added measure of safety in the blender system 100. In a preferred embodiment, the entire blender system 100 is also mounted on a truck. The truck engine then supplies the motive power for all of the blender assembly 300 functions and is electronically controlled. The minimal size of the resulting blender system 100 in the preferred embodiment allows for easier retrofits to existing oilfield equipment.

The operation of the preferred embodiment of the blender system 100 will now be described. In the preferred embodiment, the blender system 100 is mounted on a truck or other transport vehicle having an electronically controlled engine 310.

The electronically controlled truck engine 310 is normally used to power a truck or other transport vehicle when transporting the blender system 100 to and from job sites. When the truck or other transport vehicle is set up to function as a blender system 100, the truck engine 310 is manually shifted to provide power to the various hydraulic systems that power the devices within the blender assembly 300. During operation of the preferred embodiment, the blender system 100 is operated by the control system 200 under the control of the system controller 210 with operator input via the control pendants 240 and 250.

The system controller 210 then assumes control of the electronic engine throttle through an auxiliary throttle input on the electronically controlled engine 310. The engine 310 is generally run at full throttle to supply the necessary horsepower to the blender assembly 300 when in operation. The engine 310 is run at idle during periods of standby. The important operating parameters sensed by the electronic engine 310 (in the preferred embodiment this is a Caterpillar diesel engine, model no.3406E) are sent via a serial data line to the system controller 210. The system controller 210 displays the parameters normally of interest to the control operator on the control pendants 240 and 250. The parameters sent by the engine 310 include: engine status, power-take-off (PTO) status, PTO oil temp, percent throttle, percent engine load, fuel delivery pressure, engine oil pressure, boost pressure, turbo oil pressure, intake manifold temp, engine coolant pressure, engine coolant pressure, battery voltage, fuel temperature, engine oil temperature, turbo oil temperature, fuel rate and engine RPM.

The gelled fracturing fluid from the source of gelled fracturing fluid 305 is introduced into the centrifugal pump assembly 315 as indicated by the arrow in FIG. 1*a*. The centrifugal pump assembly 315 is driven by a hydrostatic drive system including a hydraulic motor powered by the PTO from the engine 310. The hydrostatic drive is controlled by a pulse width modulated (PWM) signal sent by the system controller 210. The system controller 210 senses the speed of the pump via a magnetic speed sensor installed in the hydraulic motor. This allows the system controller 210 to maintain a substantially constant motor speed which translates to a substantially constant fluid pressure into the blending tub assembly 350.

The fluid flow rate into the blending tub assembly 350 is measured by the first magnetic flowmeter 320 and the first turbine flow meter 325. Both a magnetic flowmeter and a turbine flowmeter are employed because the first magnetic flowmeter 320 is not sensitive to the viscosity changes that occur when the amount of gel added to the fracturing fluid changes. The first turbine flowmeter 325 is furthermore used for jobs that use oil based fluids that a cannot be sensed by the first magnetic flowmeter 320.

The first and second pressure sensors 335 and 370 provide information relevant to the stability of the rate of fluid flow through the blender assembly 300. This allows the operator to set pumping rates for the centrifugal pump assembly 315 and the impeller within the blending tub assembly 350 simultaneously and thereby provides for stable operation.

The blender assembly 300 employs three remote actuated flow control valves 340, 345 and 365. The suction flow control valve 340 and the discharge flow control valve 365 allow fluid to pass through the blending tub assembly 350 where the proppant is added. In the event the well being treated reaches its limit as to the amount of sand it can accept, a condition commonly known as a "screen out," the suction flow control valve 340 and the discharge flow control valve 365 must be closed and the bypass flow control valve 345 opened to bypass the blending tub assembly 350 and immediately begin sending proppant free fluid to the well. Because it is important that this operation be accomplished as quickly as possible, the control pendants 240 and 250 preferably have a single "bypass" button that simultaneously operates all three valves 340, 345 and 365 and stops the proppant auger assemblies 520*a* and 520*b* that add proppant to the blending tub assembly 350.

The blending tub assembly 350 is preferably provided in accordance with that disclosed in U.S. Pat. No. 4,239,396, the disclosure of which is incorporated herein by reference. The fracturing fluid is introduced into one side of the blending tub assembly 350.

An impeller pump assembly within the blending tub assembly 350 serves three functions. First, vanes at the top of the blending tub assembly 350 contain the fracturing fluid in the blending tub assembly 350 while allowing proppant to enter the blending tub assembly through the spinning vanes of the impeller. Secondly, vanes deeper in the blending tub assembly 350 serve to agitate the fracturing fluid for the purpose of providing a consistently blended slurry. Thirdly, the vanes act as a pump impeller to discharge the fluid mixture from the blender tub assembly 350 to the high pressure pumps (not illustrated) that pump the final slurry into the well. The impeller pump within the blending tub assembly 350 is preferably driven from the top by a hydraulic motor that is part of a hydrostatic drive system. The system controller 210 senses the speed of the hydraulic motor via a magnetic sensor installed in the hydraulic motor. The hydraulic motor speed is then preferably controlled by a pulse width modulated signal supplied to a servo valve that controls the hydrostatic drive for the pump from the system controller 210.

The two proppant additive assemblies 360*a* and 360*b* preferably include inclined screw augers designed to deliver proppant, externally fed into a hopper at the rear of the blender assembly 300, to the top of the blending tub assembly 350. The proppant is conveyed to the top of the blending tub assembly 350 where it falls through the rotating sealing vanes of the blending tub pump impeller and into the blending tub assembly 350.

The proppant auger assemblies 520*a* and 520*b* are preferably driven by hydrostatic drives in a manner similar to the centrifugal pump assembly 315 and blending tub assembly pump impeller with the exception that the speed of the proppant augers is sensed by an optical encoder to give increased resolution of the speed signal. Each turn of the proppant augers delivers a fixed volume of proppant. A proportional-integral-differential (PID) algorithm accurately controls the speed of the proppant augers. The proppant augers dispense an exact rate of proppant into the blending tub assembly 350 creating a slurry of the exact proportion of fluid and proppant to fluid.

Since the fluid rate is being constantly sensed by the suction flowmeters 320 and 325, the system controller 210 allows the operator to enter in a preprogrammed sequence of proppant loading via the control pendants 240 and 250. These program steps may comprise either a constant loading for each stage referred to as a "step" or a constantly increasing loading referred to a "ramp". The program is designed to follow an operator input schedule based on the discharge volume of the blender tub assembly 350 as measured by the discharge flowmeters 375 and 380. The proppant rate delivered by the auger additive assemblies 360*a* and 360*b* is based upon the displacement of the auger assemblies 520*a* and 520*b* as measured by the optical encoders mounted on the hydraulic motors. The relationship between the number of turns of the proppant augers and the sand delivered to the blending tub assembly 350 is only approximately linear. Therefore the actual density of the slurry is measured by a nuclear density meter 385.

The density signal provided by the densimeter 385 is converted by the system controller 210 to a value indicating pounds of proppant added to a gallon of clean fluid. This information is used by the system controller 210 to adjust the value used to describe the amount of proppant delivered per revolution of the proppant auger.

Each of the liquid additive assemblies 330*a*, 330*b* and 330*c* include a positive displacement chemical pump that is driven by a hydraulic motor. The hydraulic motors are in turn controlled by electric-over-hydraulic servo valves which in turn are controlled by a pulse width modulated (PWM) signals generated by the system controller 210. The speed of the hydraulic motors are measured by magnetic sensors that generate the hydraulic motor speed signals 440*a*, 440*b* and 440*c*. These hydraulic motor speed signals are proportional to the chemical additive flow rates since the pumps used are positive displacement pumps. Additionally, the chemical additive rates are also monitored by coreollis effect mass flowmeters 430*a*, 430*b* and 430*c* which generate the additive flow rate signals 450*a*, 450*b* and 450*c*. Either of these signals, the hydraulic motor speed signals 440*a*, 440*b* and 440*c* or the additive flow rate signals 450*a*, 450*b* and 450*c*, can be selected by the control operator as the basis for a P-I-D control loop to proportion the chemical additive to the flow rate of the slurry going through the blender assembly 300.

The chemicals additive rates may also be set up based on the discharge volume of the blender assembly 300, so that different additives are blended with the slurry as required throughout the treatment. In a similar way, dry additives are added to the slurry from the top of the blending tub assembly 350. The dry additive assemblies 355*a* and 355*b* preferably include horizontal auger style feeders driven in the same manner as the liquid additive assemblies 330*a*, 330*b* and 330*c*.

In a preferred embodiment, the relationship between each turn of the dry additive auger assemblies 490*a* and 490*b* and the volume of dry additive transported to the blending tub assembly 350 is used as a calibration factor in the operation of the dry additive assemblies 355*a* and 355*b* of the blender system 100.

The blender system 100 illustrated and described in the illustrative embodiments has been presented as a particular implementation on a blender system for producing geological formations, however the blender system 100 can also be used on other equipment commonly found in oilfield service such as cement blenders, additive units, continuous gelling blenders, acid blenders, etc.

An apparatus for the control of various pieces of mechanical equipment used in the oilfield service industry has been presented. The apparatus includes a unique control architecture wherein a microprocessor that performs closed loop control functions is contained in a single system controller. The system controller has none of the operator interface controls located on it. This configuration enhances the reliability of the control system in that no penetrations are made in the enclosure for knobs, switches, or other types of operator controls.

The apparatus eliminates the operator interface on the system controller thereby allowing the control unit to be located in an area that reduces the amount of cable required. This allows locating the control unit in a location that optimizes its environmental protection and ease of service, since proximity to the operator is not a concern.

The apparatus further provides all of the electronic control components in a single enclosure that allows the entire functioning assembly to be changed as a unit very quickly. This is an important criterion that minimizes downtime and greatly reduces the technical expertise required to make the major piece of equipment functional again.

The apparatus communicates all of the operator information via a single cable isolating the functions that are required for control of the system in the system controller from the functions that are required for operator input in the control pendants.

The apparatus is furthermore designed such that its size and weight allow for easy mobile operation by the control operator where two or more identical remote control pendants allow simultaneous control of the apparatus from different operator positions.

The apparatus provides an operator interface in which the nomenclature describing the operator input control buttons can readily changed by inserting new control pendant keyboard legends from the rear of the panel inside the enclosure for the control pendants. This allows the control pendants to be easily reconfigured to control different types of equipment.

The apparatus includes hardware and software for the operator interface that is designed such that it only displays and forwards information from the operator via a single cable. This allows the control pendants to be used in widely varied applications with no changes to the hardware or software. Reconfiguration of the system for each additional application is accomplished by simply modifying only the software in the system controller.

An apparatus and method for controlling equipment used in the oilfield pressure pumping service industry has been described. The system is comprised of a dedicated control computer mounted on the apparatus to be controlled and includes one or more remote operator units. The control computer interfaces with all the sensors and control elements of the apparatus. The control computer further communicates with other computerized equipment on the apparatus such as engines, speed sensors, pressure sensors and flowmeters to extract data and perform control functions. The control computer has no operator controls. The control computer communicates via a single electrical cable to the remote operator units. The operator unit is a small portable unit that provides the complete operator interface. The operator unit includes graphic/alpha-numeric liquid crystal displays and light emitting diode displays which provide the operating status of the system. The operator unit also includes key switches which are used for controlling the apparatus.

While the apparatus has been described with reference to specific illustrative embodiments for use in a blender system, the teachings of the present illustrative embodiments will find wide application to any number of operating systems requiring control of a plurality of devices.

What is claimed is:

1. A blender system for preparing a fluid mixture for fracturing and propping an oil bearing geological formation, comprising:

(a) a blender apparatus adapted to prepare said fluid mixture, said blender apparatus including control devices adapted to receive control signals and sensing devices adapted to transmit sensor signals;

(b) a programmable system controller operably coupled to said blender apparatus adapted to calculate and transmit said control signals to said control devices and receive said sensor signals from said sensing devices, the system controller including a memory storing blending process programs; and (c) a least one programmable control pendant operably coupled to said programmable system controller to provide an operator interface thereto, each control pendant adapted to receive input commands from an operator and display status conditions of said control devices and said sensing devices to said operator, each programmable control pendant being contained in a housing having a face plate situated on a surface of the housing, the face plate containing a plurality of displays, a plurality of key pad sets, each key pad set comprising at least one key.

2. The blender system of claim 1, wherein said at least one programmable system controller comprises a plurality of programmable control pendants.

3. The blender system of claim 1, wherein said programmable system controller is adapted to perform all control loop functions for said blender apparatus.

4. The blender system of claim 1, wherein said programmable system controller includes:

(a) a microprocessr adapted to process said sensor signals and generate said control signals; and (b) a plurality of input/output devices operably coupled to said microprocessor adapted to transmit said control signals to said control devices and receive said sensor signals from said sensing devices.

5. The blender system of claim 1, wherein each of said programmable control pendants include:

(a) a microprocessor adapted to process said operator input commands;

(b) a plurality of input/output devices operably coupled to said microprocessor adapted to receive and transmit said operator input commands to said microprocessor.

6. The blender system of claim 1, wherein said programmable system controller is mounted on said blender apparatus.

7. The blender system of claim 1, wherein said blender apparatus is mounted on a motorized vehicle.

8. The blender system of claim 7, wherein said programmable system controller is also mounted on said motorized vehicle.

9. The blender system of claim 1, wherein said programmable system controller is adapted to transmit and receive all operator information via a single cable.

10. The blender system of claim 9, wherein said cable comprises a five-conductor cable.

11. The blender system of claim 1, wherein said control programmable control pendants each include at least one removable key pad legend identifying the functionality of predetermined keys, wherein the housing is adapted such that the key pad legend is slidably received behind the face plate.

12. The blender system of claim 1, wherein the plurality of displays include at least first and second displays.

13. The blender system of claim 1, wherein the plurality of displays include at least first and second main displays, a special-purpose display, a status display, and an alarm display.

14. The blender system of claim 1, wherein the plurality of key pads include at least first and second function keypads, a general purpose keyboard, a data entry keyboard, and a special-purpose keyboard.

15. A computer implemented method of operating a blender system for preparing a fluid mixture for fracturing and propping an oil bearing geological formation, said blender system including a plurality of control devices adapted to receive a plurality of control signals and a plurality of sensing devices adapted to generate a plurality of sensor signals, comprising:

(a) receiving said sensor signals by a system controller;

(b) receiving operator input commands via any of a plurality of control pendants and transmitting the operator input commands to the system controller;

(c) processing said sensor signals and said operator input commands to generate said control signals; and (d) modifying said processing as a function of said operator input commands.

16. The computer implemented method of claim 6, wherein said processing includes:

(a) calculating said control signal as a function of said sensor signals and said operator input command.

17. The computer implemented method of claim 15, further comprising containing said system controller in a single enclosure without interface controls situated thereon.

18. The computer implemented method of claim 15, wherein said blender system is mounted on a motorized vehicle, the method further comprising mounting the system controller on said motorized vehicle.

19. The computer implemented method of claim 15, further comprising receiving said operator input commands via a plurality of key pads located on each of said control pendants.

20. The computer implemented method of claim 15, further comprising displaying said operator information on a plurality of displays located on each of said control pendants.

21. A control system for a blender apparatus adapted to prepare a fluid mixture for fracturing and propping an oil bearing geological formation, the blender apparatus including control device adapted to receive control signals and sensing devices adapted to transmit sensor signals, the control system comprising:

an enclosure containing a microprocessor and a memory storing blending process programs, the microprocessor adapted to calculate and transmit said control signals to said control devices and receive said sensor signals from said sensing devices; and a plurality of programmable control pendants coupled to exchange data with the microprocessor, each control pendant adapted to provide an operator interface to the control system, each of the programmable control pendants being contained in a housing having a face plate situated on a surface of the housing, the face plate containing a plurality of displays, a plurality of key pads sets, each key pad set comprising at least one key.

22. The control system of claim 21, wherein each of said control programmable control pendant includes at least one removable key pad legend identifying the functionality of predetermined keys, wherein the housing is adapted such that the key pad legend is slidably received behind the face plate.

23. The control system of claim 21, wherein the plurality of displays include at least first and second main displays, a special-purpose display, a status display, and an alarm display.

24. The control system of claim 21, wherein the plurality of key pad sets include at least first and second function keypads, a general purpose keyboard, a data entry keyboard, and a special-purpose keyboard.

* * * * *